US009080750B2

(12) United States Patent
Salomon

(10) Patent No.: US 9,080,750 B2
(45) Date of Patent: Jul. 14, 2015

(54) INTER-LOCKING MECHANISM FOR LIGHTING COMPONENTS AND METHOD THEREOF

(71) Applicant: SPECIALTY LIGHTING INDUSTRIES, INC., Ocean, NJ (US)

(72) Inventor: Ben Salomon, Elberon, NJ (US)

(73) Assignee: Specialty Lighting Industries, Ocean, NJ (US)

( * ) Notice: Subject to any disclaimer, the term of this patent is extended or adjusted under 35 U.S.C. 154(b) by 0 days.

(21) Appl. No.: 14/287,287

(22) Filed: May 27, 2014

(65) Prior Publication Data

US 2014/0334163 A1 Nov. 13, 2014

Related U.S. Application Data

(62) Division of application No. 13/774,912, filed on Feb. 22, 2013.

(60) Provisional application No. 61/601,918, filed on Feb. 22, 2012.

(51) Int. Cl.

| | |
|---|---|
| ***F21V 17/18*** | (2006.01) |
| ***F21V 19/00*** | (2006.01) |
| ***F21V 17/14*** | (2006.01) |
| *F21Y 101/02* | (2006.01) |
| *F21W 131/402* | (2006.01) |
| *F21V 29/74* | (2015.01) |
| *F21V 29/76* | (2015.01) |

(52) U.S. Cl.

CPC ..... *F21V 17/18* (2013.01); *F21V 17/14* (2013.01); *F21V 19/003* (2013.01); *F21V 29/74* (2013.01); *F21V 29/76* (2013.01); *F21W 2131/402* (2013.01); *F21Y 2101/02* (2013.01)

(58) Field of Classification Search

CPC . F21V 17/18; F21V 19/003; F21W 2131/402
See application file for complete search history.

(56) References Cited

U.S. PATENT DOCUMENTS 4,513,356 A * 4/1985 Mikola ..... 362/645

* cited by examiner

*Primary Examiner* — Elmito Breval
(74) *Attorney, Agent, or Firm* — Brosemer, Kolefas & Associates

(57) ABSTRACT

Embodiments of the disclosure provide a locking mechanism for securing lighting components to each other, particularly a light-emitting diode (LED) or light engine to a heat sink. The locking mechanism comprises: a base component and a retention ring. The base component comprises: a mounting component comprising a lighting component compartment; and an assembly component comprising: an opening through which wires pass, at least two slots or ramps, and at least one bottom ledge. The retention ring further comprises: at least two winged protrusions, each to engage with a slot of the assembly component, at least one top and bottom ledge, and at least one slot.

4 Claims, 36 Drawing Sheets

INTER-LOCKING MECHANISM FOR LIGHTING COMPONENTS AND METHOD THEREOF

CROSS-REFERENCE TO RELATED APPLICATIONS

The present application claims the benefit under 35 U.S.C. §120 of U.S. patent application Ser. No. 13/774,912, which was filed on Feb. 22, 2013 which in turn is based upon and claims the benefit of U.S. Provisional Application Ser. No. 61/601,918 filed Feb. 22, 2012, entitled "LOCKING MECHANISM FOR LIGHTING COMPONENTS," which is incorporated herein by reference in its entirety.

BACKGROUND

1. Field of the Invention

Embodiments of the present invention generally relate to a locking mechanism. More specifically, the present invention relates to a locking mechanism for securing lighting components, such as light-emitting diodes (LED) or light engine, without necessarily using screws or other fasteners, and a method of using the same.

2. Description of Related Art

Lighting fixtures have many components and parts, in addition to the lamp or lighting module. This may include, for example, a housing, a ballast, a reflector, or a heat sink for light-emitting diodes (LED) or other light engine. Lighting fixtures may vary greatly in size and complexity, depending on various factors such as aesthetics, desired illumination levels, or space constraints. As such, the lighting components will also vary in size as well as in the quantity of the required components.

Lighting fixtures are typically assembled in a factory or warehouse, often manually by a laborer. The various components of a lighting fixture are often attached to each other through the use of fasteners, such as screws or bolts. Depending on the size of the lighting fixture and lighting components, the fasteners could be small in size while numerous in quantity. As such, assembly of the lighting components in a factory or warehouse can be extremely labor intensive and time consuming, which increases manufacturing costs, and ultimately the cost of the final product.

For example, in a light fixture utilizing an LED module or light engine, due to the high electricity draw of LEDs/light engines, the LED or light engine module is typically mounted to a heat sink to draw the heat away from the LED or light engine. One way this is currently done is by mounting a heat sink to one side of a base using several screws, and mounting the LED or light engine module to the other side of the base. Because the base acts as a conductor to transfer heat from the LED or light engine module to the heat sink, there must be solid contact between the surfaces of the LED light engine module and the base, making it necessary to tightly secure the LED or light engine module to the base. This is typically done through the use of a collar that holds the LED or light engine module to the base. The collar is secured to the base by several screws. The screws, typically small mounting screws, for mounting both the collar and the heat sink are quite small. Therefore, a lot of time and labor are expended to assemble the light fixtures.

In addition, after the lighting fixture has been assembled and installed in the field, it will eventually require maintenance of some sort, such as the replacement of a bulb or another faulty component. Using the example of the LED or light engine light fixture discussed above, this will require unscrewing the collar to access the LED or light engine module. As with the assembly stage, this can be a labor intensive process. Because the lighting fixture is already installed in either a wall or a ceiling, it can be painstaking procedure to remove each screw attaching the collar to the base in order to access the LED or light engine module, thereby increasing maintenance costs. In addition, because the screws are very small, at least one screw could easily be lost, thereby negatively affecting the collar's hold of the LED or light engine module against the base after the faulty component is replaced and the fixture is reassembled. This in turn will decrease the contact between the LED or light engine module and the base, and therefore reduce the efficiency of the LED or light engine.

Therefore, a need exists for a locking mechanism for securing various lighting components to each other, in particular LED or light engine modules to a heat sink, and a method of using the same, in an efficient, cost-saving yet effective manner.

SUMMARY

Embodiments of the present invention generally relate to a locking mechanism for securing lighting components to each other, such as an LED or light engine module to a heat sink, without the use of extraneous fasteners, and a method of using the same. In one embodiment of the present invention, there is provided a locking mechanism comprising: a base, and a retention ring. The base further comprises: a mounting component comprising a lighting component compartment in which the lighting component sits; and an assembly component comprising: at least one opening in at least one wall of the assembly component through which wires of the lighting component pass, at least two slots or ramps in at least one wall of the assembly component, and at least one ledge extending inward from the bottom of the assembly component wall.

The retention ring may include: at least one wall to surround the lighting component, at least one top ledge to engage with the surface of the lighting component, and at least two winged protrusions, each to engage with one slot or ramp of the assembly component. The lighting component sits in the lighting component compartment of the base. The retention ring slides into the assembly component over the lighting component, holding it against the base. When the retention ring is rotated, the winged protrusions will engage with the slots or ramps of the assembly component of the base, thereby securing the lighting component such that its surface is firmly in contact with the base.

In accordance with another embodiment, there is provided an apparatus or a kit for securely locking a lighting component, the apparatus or the kit comprising: a base, a retention ring, and an assembly tool. The base further comprises: a mounting component comprising a lighting component compartment in which the lighting component sits; and an assembly component comprising: at least one opening in at least one wall of the assembly component through which wires of the lighting component pass, at least two slots or ramps in at least one wall of the assembly component, and at least one ledge extending inward from the bottom of the assembly component wall. The retention ring further comprises: at least one wall to surround the lighting component, at least one top ledge to engage with the surface of the lighting component, at least two winged protrusions, each to engage with one slot or ramp of the assembly component, and at least one stopper. The assembly tool comprises a head and a connection component.

The lighting component sits in the lighting component compartment of the base. The retention ring slides into the assembly component over the lighting component, holding it against the base. The assembly tool attaches to a socket wrench, nut driver, or a similar tool, by the connection component, and then fits into the opening of the retention ring. When it is rotated, the head will engage with at least one stopper of the retention ring, causing the winged protrusions of the retention ring to engage with the slots or ramps of the assembly component of the base, thereby securing the lighting component such that its surface is firmly in contact with the base. This creates a relatively tighter fit than if the retention ring were rotated manually without mechanical means.

In accordance with another embodiment, there is provided a method for securely interlocking lighting components to each other. The method comprises providing a locking mechanism comprising: a base, and a retention ring. The base further comprises: a mounting component comprising a lighting component compartment in which the lighting component sits; and an assembly component comprising: an opening in at least one wall of the assembly component through which wires of the lighting component pass, at least two slots or ramps in at least one wall of the assembly component, and at least one ledge extending inward from the bottom of the assembly component wall. The retention ring further comprises: at least one wall to surround the lighting component, at least one top ledge to engage with the surface of the lighting component, and at least two winged protrusions, each to engage with one slot or ramp of the assembly component. The method further comprises: placing the lighting component intended to be secured into the lighting component compartment; positioning the lighting component compartment such that wires of the lighting component pass through the opening in the wall of the assembly component of the base; sliding the retention ring into the assembly component until a top surface of the at least one top ledge comes into contact with a bottom surface of the lighting component; and rotating the retention ring until the winged protrusions come into contact with the edges of the assembly component slots or ramps, creating a compression force between the winged protrusions and the slots or ramps such that the lighting component is securely locked.

Further, in accordance with another embodiment of the present invention, an apparatus is provided for securely locking a lighting component. The apparatus may include a base, a retention ring and a hand assembly tool. The base may include a lighting component. The retention ring may be slidable into the base over the lighting component. Further, the hand assembly tool may include an assembly base having one or more protrusions on a first side thereof. Further, the hand assembly tool may include a handle coupled to a second side of the assembly base. The handle may be capable of engaging the one or more protrusions with at least one stopper of the retention ring for engaging the retention ring with the base and thereby secures the lighting component in contact with the base. Herein, the first side and the second side of the assembly base may be opposite to each other.

BRIEF DESCRIPTION OF THE DRAWINGS

The above and still further features and advantages of the present invention will become apparent upon consideration of the following detailed description of embodiments thereof, especially when taken in conjunction with the accompanying drawings.

Figure 1:
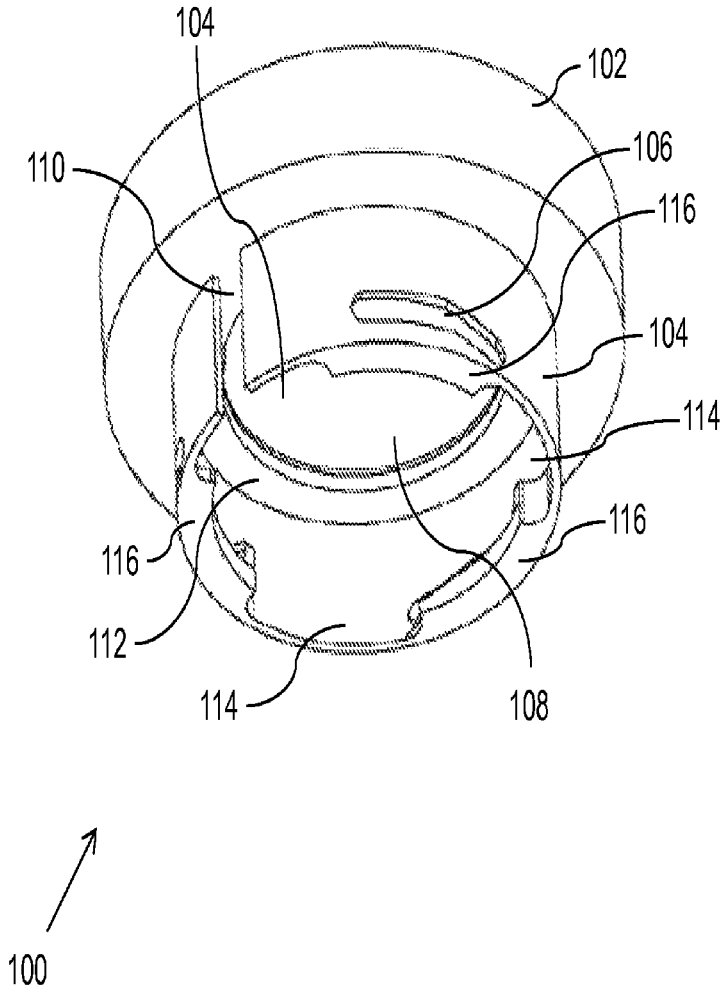
FIG. 1 depicts a perspective view of a base in accordance with an embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

DETAILED DESCRIPTION

In the following detailed description, numerous specific details are set forth in order to provide a thorough understanding of embodiments or other examples described herein. In some instances, well-known methods, procedures, components and circuits have not been described in detail, so as to not obscure the following description.

Further, the examples disclosed are for exemplary purposes only and other examples may be employed in lieu of, or in combination with, the examples disclosed. It should also be noted the examples presented herein should not be construed as limiting of the scope of embodiments of the present disclosure, as other equally effective examples are possible and likely.

Embodiments of the present invention provide a locking mechanism for securing lighting components to each other, such as light-emitting diode (LED) module or any light engine may be connected to a heat sink. Herein this disclosure, the light engine may be referred to any solid state light generating device. Further, the locking mechanism may secure the lighting components without necessarily requiring usage of screws therefor. Embodiments, of the present invention involve usage of a base and retention ring that may be utilized to secure the lighting component (such as LED/light engine), or any solid state light generating device, in the base without necessarily using screws or any external fastener. For purposes of clarity, LED, light engine and light generating device will be referred to herein as collectively LED. Similarly, in an embodiment, the present invention may allow the heat sink to connect with a compartment of the base to dissipate the heat that may be produced by the lighting component.

FIG. 1 depicts a perspective view of a base component 100 of a locking mechanism according to one embodiment of the present invention. The base 100 comprises two additional components, a mounting component 102, and an assembly component 104. The mounting component 102 may be constructed of a sturdy material capable of acting as a conductor, such as steel, aluminum, nickel, and the like. Where conductivity is not a concern, given the lighting component to be secured, the mounting component 102 may alternatively be constructed of semi-conductive or non-conductive material such as wood, plastic, glass, and the like. The assembly component 104 may also be constructed of a sturdy material, such as steel, aluminum, nickel, and the like, as well as wood, plastic, glass, and the like. The mounting component 102 and the assembly component 104 may or may not be made of the same material.

The shape of the mounting component 102 and the assembly component 104 is generally round. However, the shape may be any geometrical shape, such as a rectangle, triangle, and the like. Furthermore, the mounting component 102 and the assembly component 104 may or may not be the same shape or the same size. For instance, where the shape of the mounting component 102 and the assembly component 104 are circular, the diameter of the mounting component 102 may be larger than the diameter of the assembly component 104 as depicted in FIG. 1. Alternatively, the diameters may be the same or the diameter of the mounting component 102 may be smaller than the diameter of the assembly component 104.

The mounting component 102 may have a depressed area on its bottom side forming a compartment 108 in which the lighting component (such as LED or light engine) to be secured will sit (hereinafter, may be referred to as "lighting component compartment 108"). The lighting component compartment 108 will generally be round, but may alternatively be any shape to fit the lighting component. The depth of the lighting component compartment 108 will vary depending upon the lighting component to be secured.

The assembly component 104 comprises at least one wall (hereinafter may interchangeably be referred to as "assembly component wall"). The assembly component wall will generally surround the lighting component compartment 108 and mimic its shape. Each wall of the assembly component 104 may have at least two slots or ramps 106. In an embodiment, the assembly component 104 may have one or more slots or ramps (hereinafter referred to collectively as "slots", meaning either slots, ramps or any combination thereof). Each slot 106 may have a sloped portion. The height of the slot 106 may depend upon the height of the lighting component to be secured. Further, the slot 106 and may or may not be present depending on manufacturing process. The assembly component 104 wall may also have at least one opening 110 through which the wires of the lighting component may pass. The opening 110 may be an aperture, slot, channel, and the like and may be of any shape, such as horizontal, vertical and the like.

Figure 3:
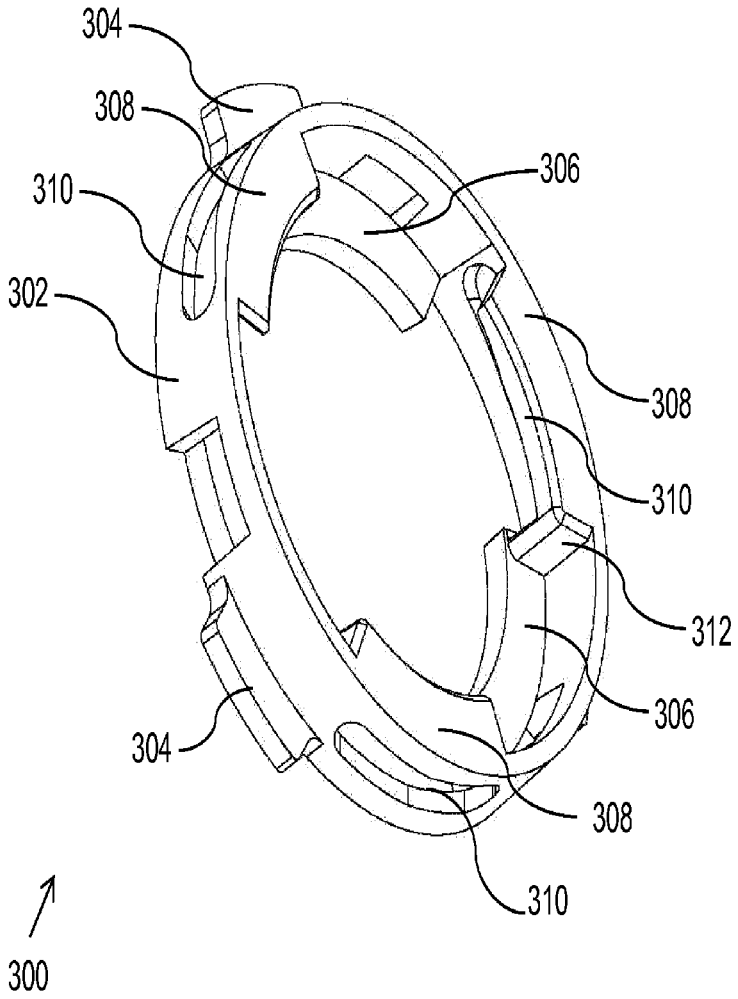
FIG. 3 is a perspective view of a retention ring, in accordance with an embodiment of the present invention.

Furthermore, the assembly component 104 may have at least one ledge 116 that extends inwardly from the assembly component wall, and at least one notch 114. The notch 114 may be shaped to fit a winged protrusion of a retention ring, as depicted in FIG. 3 and described hereinafter, so the retention ring may initially fit into the assembly component 104 of the base 100. In an embodiment, when the retention ring is rotated, the top surface of the ledge 116 (of the assembly component 104) may engage with at least a portion of the bottom surface of the winged protrusion (of the retention ring), thereby preventing the retention ring from falling out of the assembly component 104.

FIGS. 2A, 2B, 2C, 2D, 2E and 2F depict various views of a base, such as the base 100 from FIG. 1, in accordance with an embodiment of the present invention. Specifically, in FIG. 2A, a top view drawing of the base 100, and in particular, of the mounting component 102 is depicted. Similar to the bottom of the mounting component 102, the top portion may have a depressed area forming a compartment 204 for a second lighting component, such as a heat sink for a LED or light engine. Hereinafter, the compartment 204 for the second lighting component may interchangeably be referred to as "second lighting component compartment 204". The second lighting component compartment 204 may be shaped and sized such that the cavity walls of the second lighting component compartment 204 may engage with the second lighting component to create an interference fit or a protruding boss engaging a mating feature and retained through interference fit. This substantially eliminates the need for extraneous fasteners, such as screws, thereby minimizing the cost and time for both assembly and maintenance.

Figure 2A:
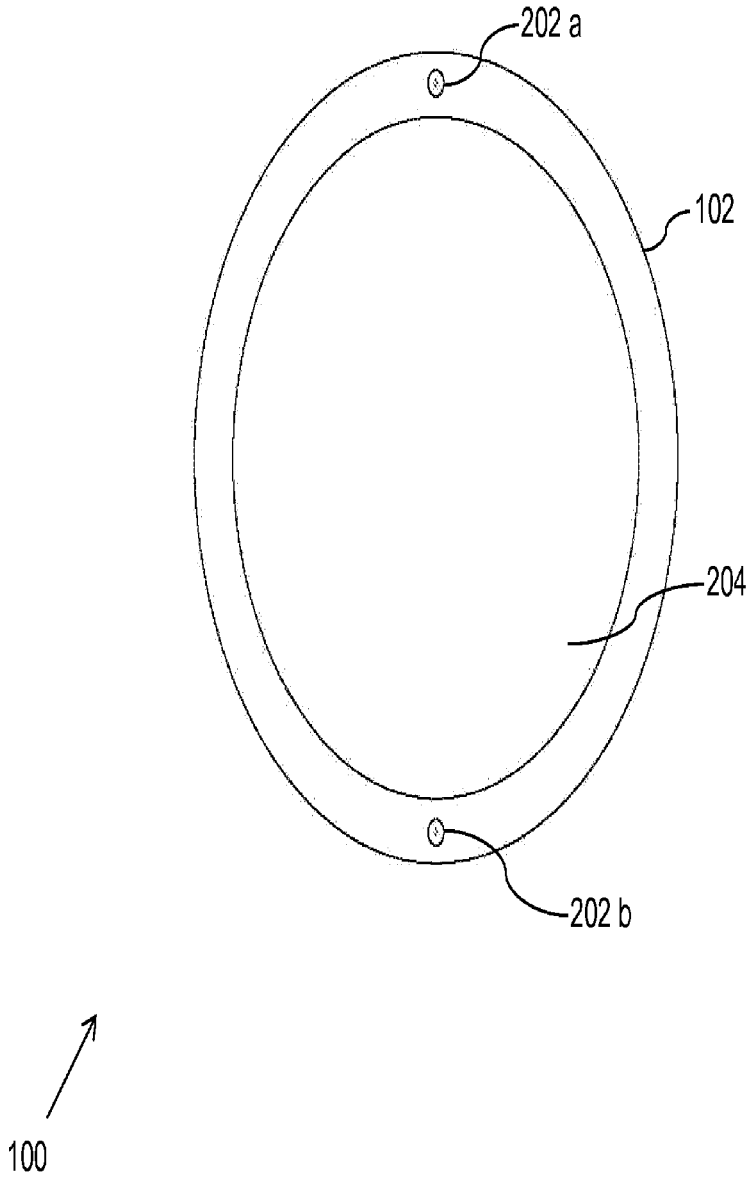
FIGS. 2A, 2B, 2C, 2D, 2E and 2F depict various views of a base in accordance with an embodiment of the present invention.
Figure 2B:
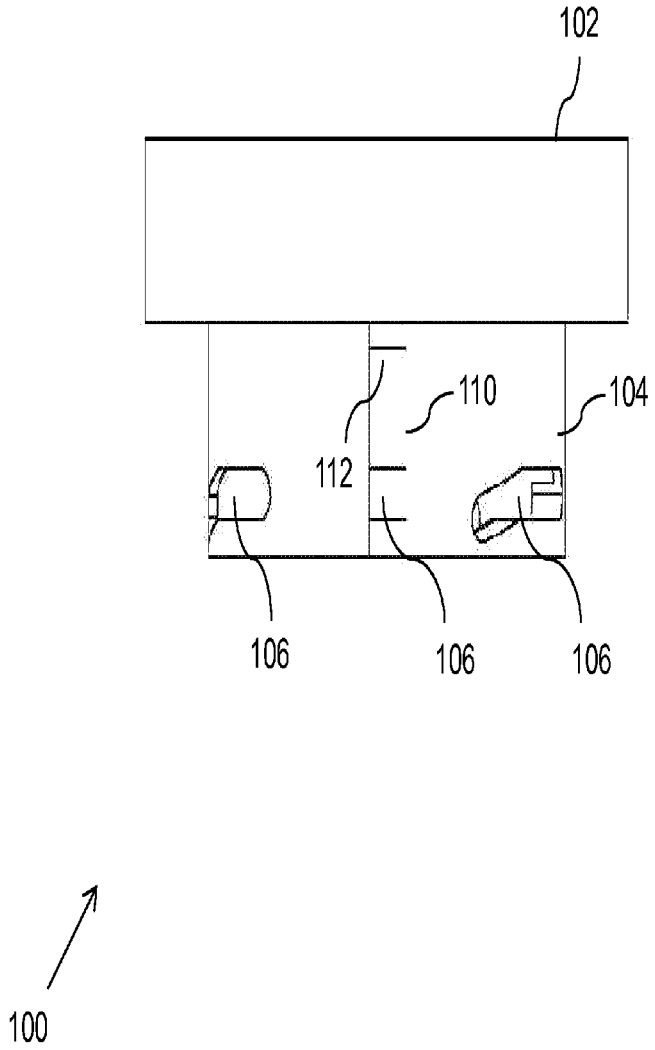
Figure 2C:
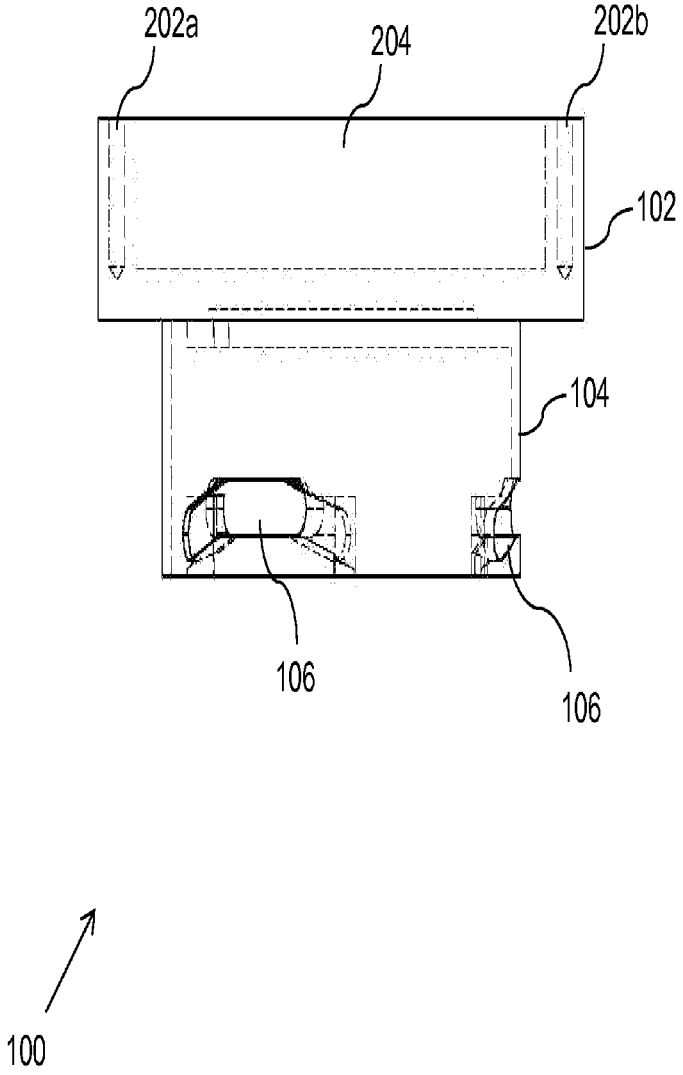
Figure 2D:
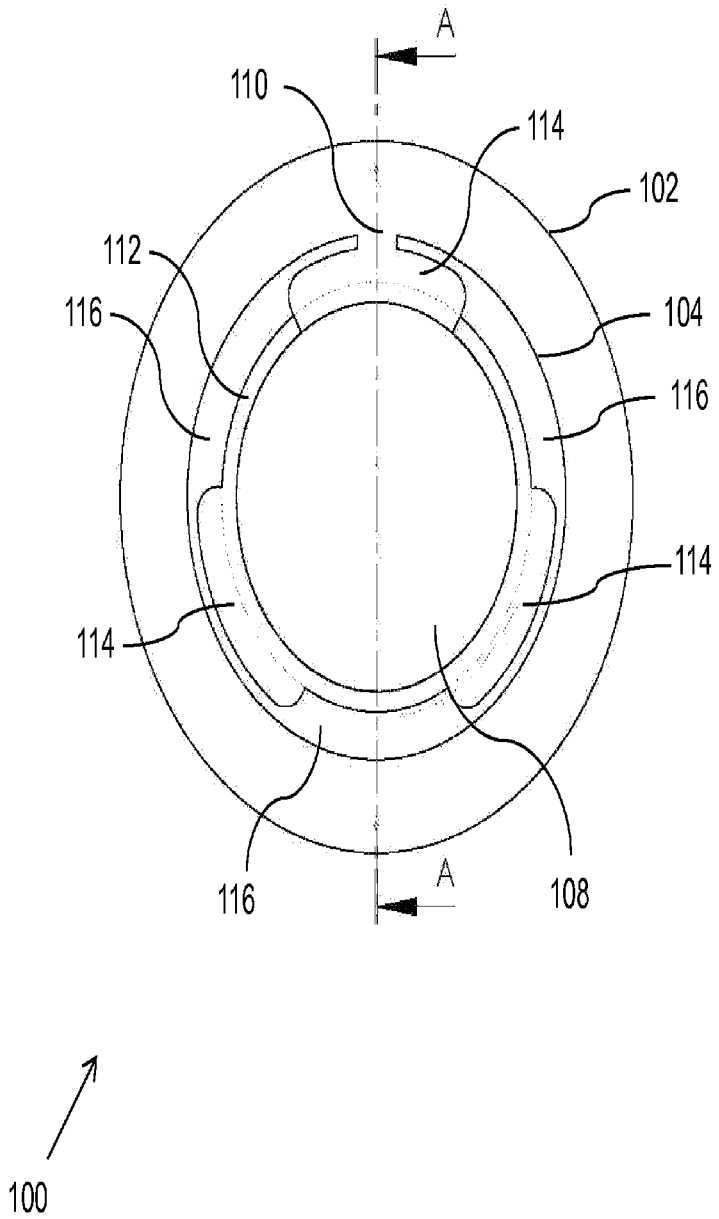
Figure 2E:
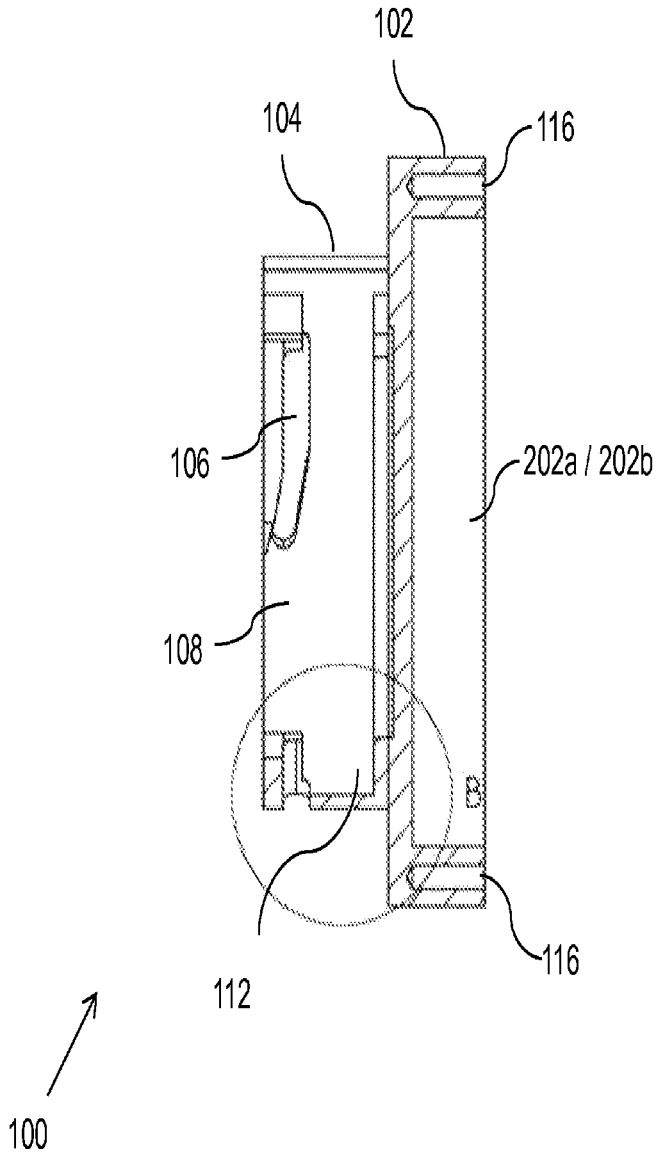
Figure 2F:
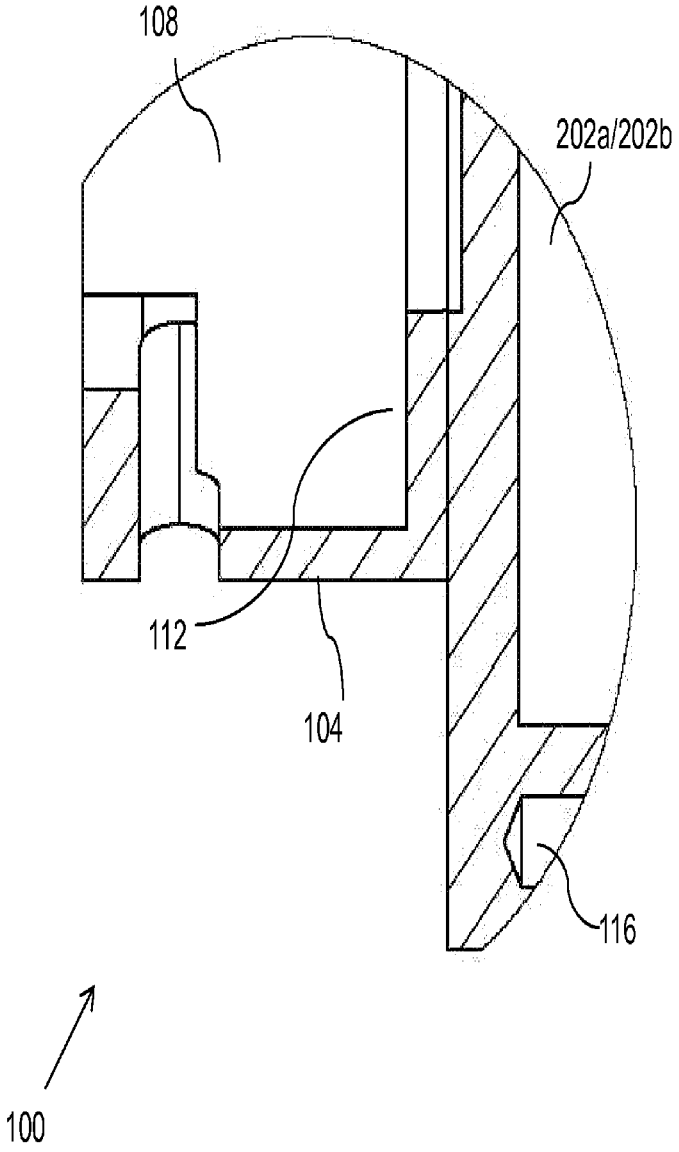

The mounting component 102 may further have holes, such as hole 202*a* and hole 202*b*, to be used for mounting the base to a ceiling or a wall or fixture housing or some type of adjustment mechanism. Hereinafter, the hole 202*a* and the hole 202*b* may collectively be referred to as 'holes 202'. Further, FIGS. 2B, 2C and 2D depict front view, side view and bottom view, respectively, of the base 100. Furthermore, FIG. 2E depicts across-sectional view of the base 100. This cross-sectional view may be taken laterally through the center of the base 100 at line A-A. Similarly, FIG. 2F depicts an expanded cross-sectional view drawing of one end of the base 100.

FIG. 3 is a perspective view drawing of a retention ring 300 according to one embodiment of the present invention. The retention ring 300 comprises at least one wall 302 (hereinafter may interchangeably be referred to as "retention ring wall 302"), and is made of a sturdy, rigid material, such as steel, aluminum, nickel, and the like, as well as wood, plastic, glass, and the like. It may or may not be made of the same material as the mounting component 102 and/or the assembly component 104 of the base 100 (as described in conjunction with FIG. 1). The shape of the retention ring 300 is generally round, as its name suggests, but may also be any other geometrical shape to match the shape of the first lighting component to be secured.

The retention ring 300 may also comprise at least two winged protrusions 304. The retention ring 300 may fit into the assembly component 104 of the base 100 such that the winged protrusions 304 fit through the notches 114 of the assembly component 104. When the retention ring 300 is rotated, the lighting component will lock into place as each of the winged protrusions 304 comes into contact with the bottom edge of a slot 106, thereby creating a compressive force between the winged protrusions 304 and the slots 106. The winged protrusions 304 are rigid members, and as such will not undergo any deformation. Furthermore, the winged protrusions 304 may be any size such that, at a minimum, they may be able to sustain the compressive force between the winged protrusions 304 and the slots 106 when the retention ring is rotated. As shown, the retention ring 300 including three winged protrusions 304. Further, it may be appreciated by a person skilled in the art that any combination of at least two winged protrusions 304 (that may fit on the retention ring wall 302) may be contemplated. The number of winged protrusions 304 may generally be the same as, but no more than, the number of slots 106 of the assembly component 104.

The retention ring 300 may further comprise at least one top ledge 306 that extends inwardly from the top of the retention ring wall 302. The top surface of the top ledge 306 may be engaged with a bottom surface of the first lighting component to be secured when the retention ring 300 is inserted into the assembly component 104. When the retention ring 300 is rotated, the top ledge 306 may hold the first lighting component in the lighting component compartment 108 in the mounting component 102 of the base 100. While three top ledges 306 are depicted in FIG. 3, it may be appreciated by a person skilled in the art that any number of top ledges 306 that may fit on the retention ring wall 302 may be contemplated. In an embodiment, the top ledges 306 may be of any arc length and may even span the entire circumference or perimeter of the retention ring 300. The extent to which the top ledges 306 extend inwardly may depend upon the dimensions of the first lighting component to be secured.

The retention ring 300 may further comprise at least one bottom ledge 308 that may extend inwardly from the bottom of the retention ring wall 302. The bottom ledge 308 may engage with a bottom surface of a second lighting component, such as a reflector. The quantity of the bottom ledges 308 and the length or arc length of the bottom ledges 308 must be such that the second lighting component may slide into the retention ring 300.

The retention ring 300 may further comprise at least two slots 310. The slots 310 may be similar to the slots 106 of the assembly component 104 of the base 100 in that they may be sloped. The edge of the slots 310 may engage with a surface of a winged protrusion on the second lighting component, creating a compressive force between the slot 310 and the winged protrusion of the second lighting component such that the second lighting component may be tightly secured.

The retention ring 300 may further comprise at least one stopper 312 that fits between the bottom surface of one top ledge 306 and the top surface of one bottom ledge 308. The stopper 312 may engage with a head of an assembly tool, as depicted in FIGS. 5A-5D and described hereinafter, when the assembly tool is rotated. Alternatively, if the retention ring 300 does not have either top ledges 306 or bottom ledges 308, the stopper may extend from the inside of the retention ring wall, 302.

Figure 4A:
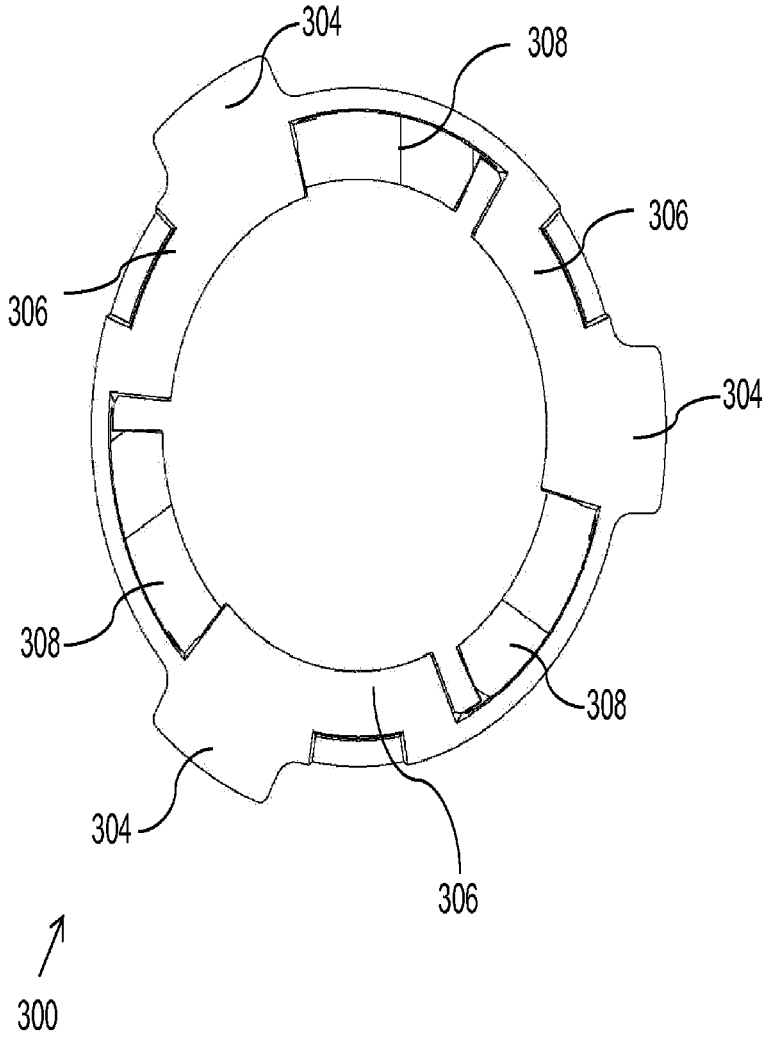
FIGS. 4A, 4B and 4C depict various views of a retention ring in accordance with an embodiment of the present invention.
Figure 4B:
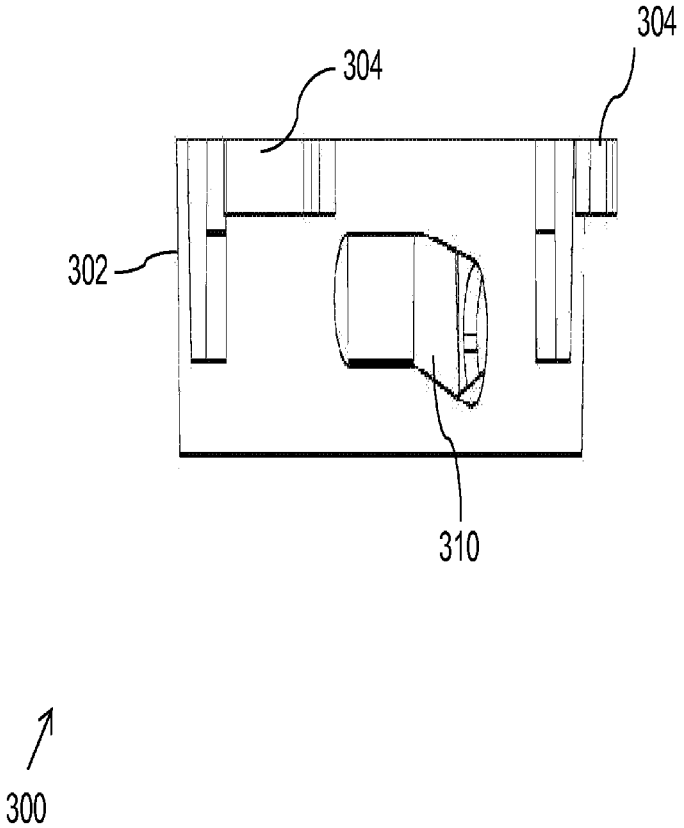
Figure 4C:
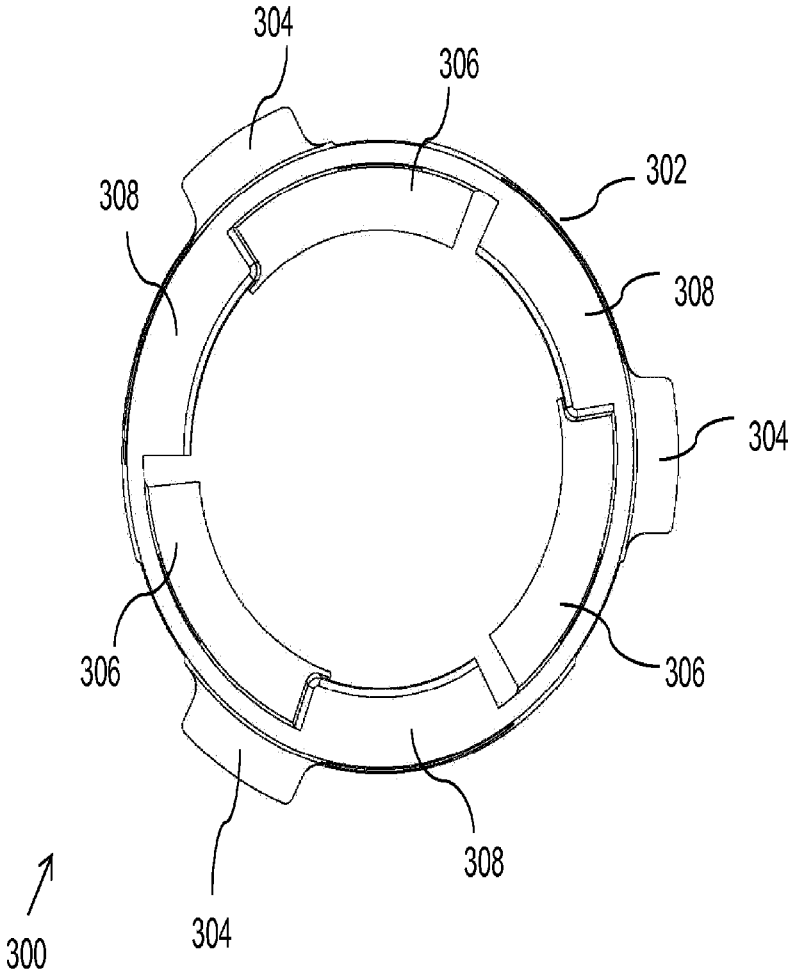

FIGS. 4A, 4B and 4C depict various views of a retention ring, such as the retention ring 300, in accordance with an embodiment of the present invention. Specifically, as shown, FIGS. 4A, 4B and 4C depict a top view, a front view, and a bottom view respectively of the retention ring 300. Various components depicted in FIGS. 4A, 4B and 4C are explained in detail previously in conjunction with FIG. 3 and thus not repeated herein for the sake of brevity.

Figure 5A:
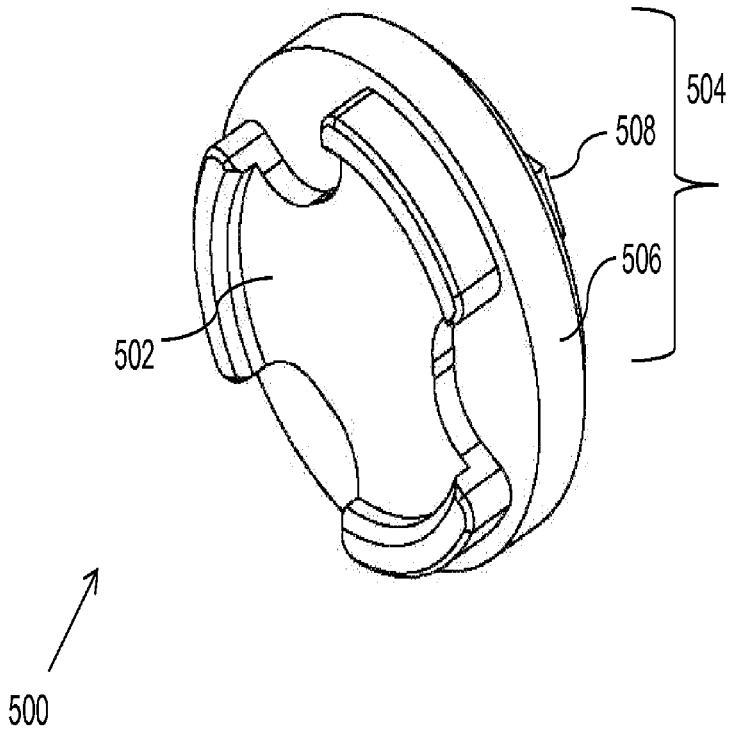
FIGS. 5A, 5B and 5C depict various views of an assembly tool in accordance with an embodiment of the present invention.
Figure 5B:
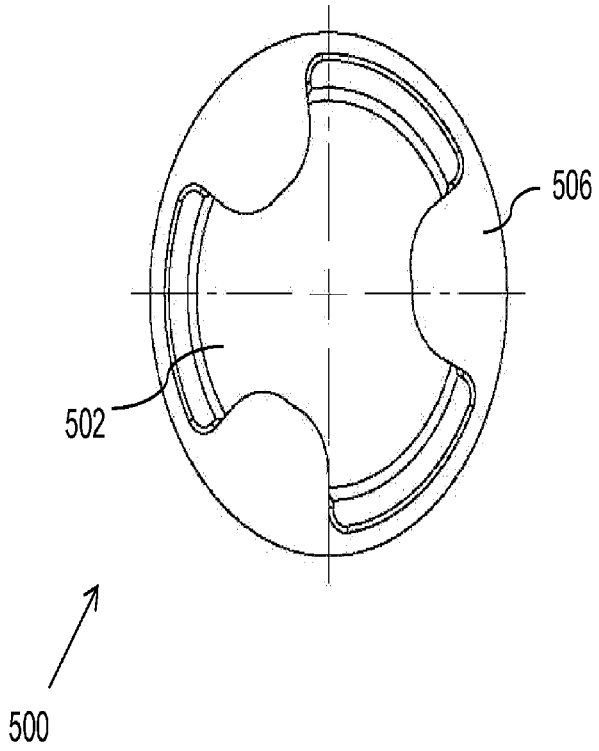
Figure 5C:
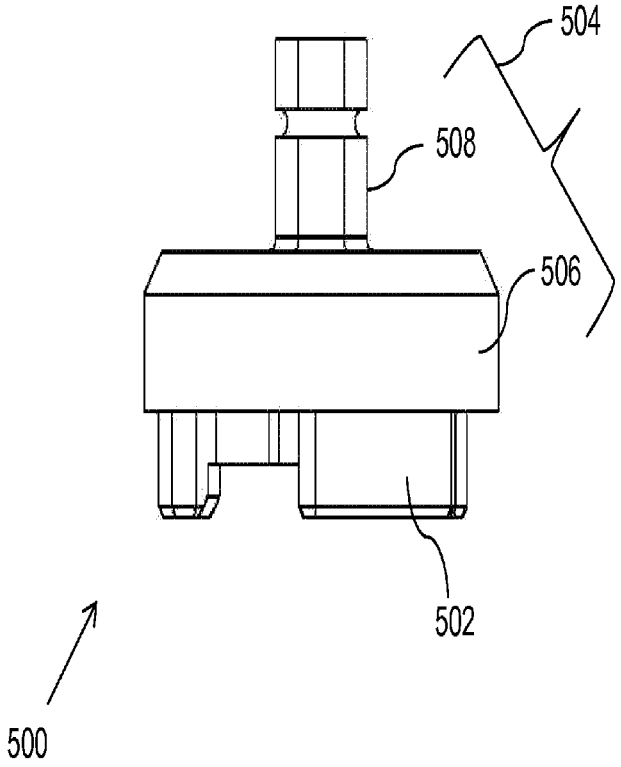

FIGS. 5A, 5B and 5C depict various views of an assembly tool, in accordance with one embodiment of the present invention. Specifically, as shown, FIGS. 5A, 5B and 5C depict a perspective view, a bottom view and a side view of an assembly tool 500, according to one embodiment of the present invention. Herein, the assembly tool 500 provides more torque through mechanical means to the rotation of the retention ring 300, such that the compressive fit between the winged protrusions 304 and the slots 106 will be maximized. Furthermore, the assembly tool 500 may ease the disassembly and reassembly of the lighting components during routine maintenance. This may reduce maintenance costs as well as the risk of error, and therefore performance deficiencies, that may otherwise result in case of lost screws.

Figure 5D:
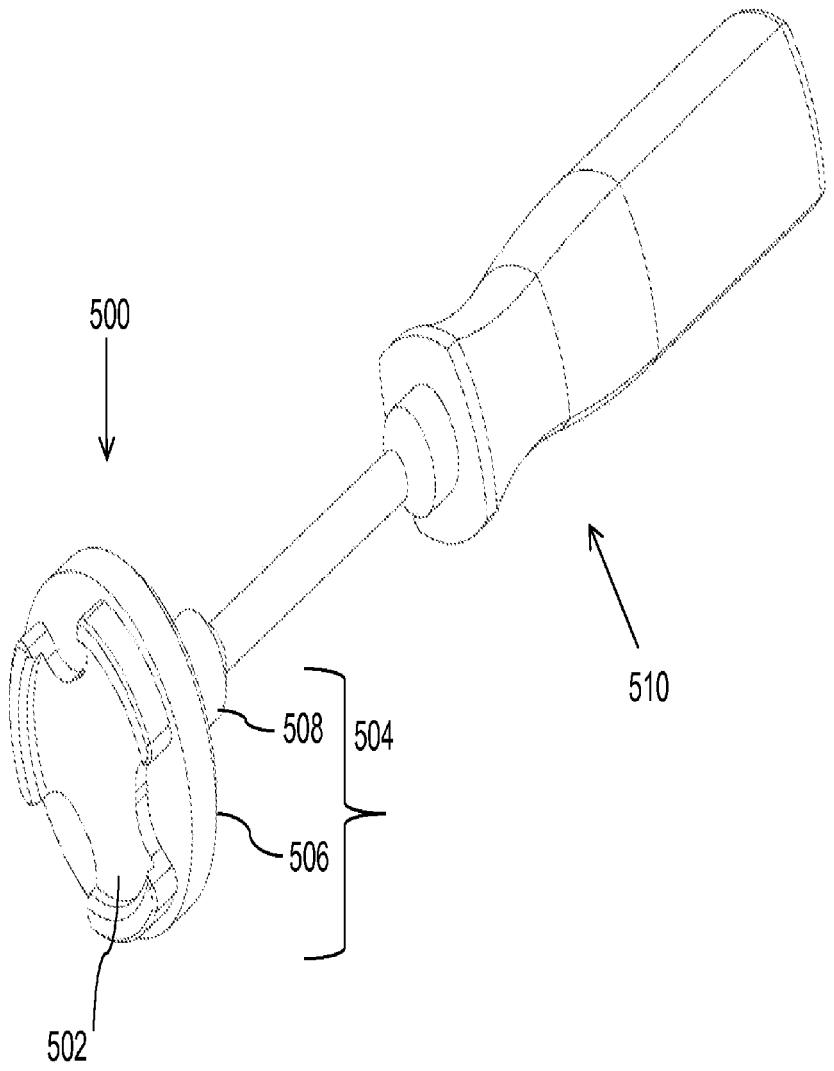
FIG. 5D depicts a perspective view of an assembly tool attached to a standard nut driver, in accordance with an embodiment of the present invention.

Further, the assembly tool 500 will generally be made of a sturdy material, such as steel, aluminum, and plastic and/or composites and the like. The assembly tool 500 may include a head 502 and a connection component 504. The connection component 504 may further comprise a base 506 and a male fitting 508. The base 506 may generally be round. Further, it may be appreciated by a person skilled in the art that the base 506 may be any geometrical shape to fit in the retention ring 300. The base 506 may connect the male fitting 508 to the head 502. Alternatively, the male fitting 508 may be attached directly to the head 502. The male fitting 508 may fit into a socket or a nut driver, as depicted in FIG. 5D and described hereinafter, and the like. The male fitting 508 may be any size that can fit on the base 506 or the head 502 and still fit into any standard size socket, nut driver, and the like, such as a 7/16 nut driver. Alternatively, the male fitting 508 may be adapted to fit directly into a socket wrench, ratchet, and the like. In an embodiment, the assembly tool 500 may have built in handle that may be utilized to engage and disengage the assembly tool 500 with the retention ring 300 for assembling or disassembling the lighting components to or from the retention ring 300 or any other assembly. The assembly tool with the built in handle (hereinafter may interchangeably be referred to as 'hand assembly tool') is explained further in conjunction with FIGS. 6A, 6B and 6C.

Further, the head 502 may be shaped and sized such that it may fit into the notches in the retention ring 300 created by the bottom ledges 308. Alternatively, in an embodiment, if the retention ring 300 does not have bottom ledges 308, the head 502 may generally be of the same shape as the retention ring 300, with openings or spaces for at least one stopper 312, and sized to fit within the inside of the retention ring wall 302. Such fitting of the head 502 within the retention ring 300 may be for creating a required torque to the retention ring 300 to enhance the compressive fitting between the winged protrusions 304 and the slots 106 of an assembly component, such as the assembly component 104.

Referring now to FIG. 5D depicting a perspective view of an assembly tool, such as the assembly tool 500 attached to a standard nut driver 510. Various components of the assembly tool 500 are explained previously in conjunction with FIGS. 5A, 5B and 5C and thus not described herein again for the sake of brevity. Hereinafter, FIGS. 5A, 5B, 5C and 5D may collectively be referred to as 'FIG. 5'. Further, the assembly tool 500 may attach to a wrench, such as a socket wrench, a nut driver, or a similar tool, by a connection component (such as the connection component 504), and then fits into the opening of the retention ring.

When the wrench (such as the nut driver 510) is rotated, the head (such as the head 502) may engage with at least one stopper of the retention ring. Due to this, the winged protrusions of the retention ring may engage with slots of the assembly component of the base (such as the base 100) and thereby securing the lighting component such that its surface is firmly in contact with the base. It may be appreciated by a person skilled in the art that the usage of the assembly tool 500 may create a tighter fit than if the retention ring were rotated manually without mechanical means.

For example, the standard nut driver 510 may be connected to the connection component 504 and utilized to fit the head, such as the head 502, (of the assembly tool 500) within the retention ring 300 that is further fitted to the assembly component 104. Accordingly, the compressive fitting between the retention ring 300 and the assembly component 104 may be increased by utilizing the assembly tool 500. Alternatively, the assembly tool 500 may have its own handle (in place of the standard nut driver 510) of any length necessary to create the required torque applied to the retention ring 300. The assembly tool with handle is described further in conjunction with FIGS. 6A, 6B and 6C.

Figure 6A:
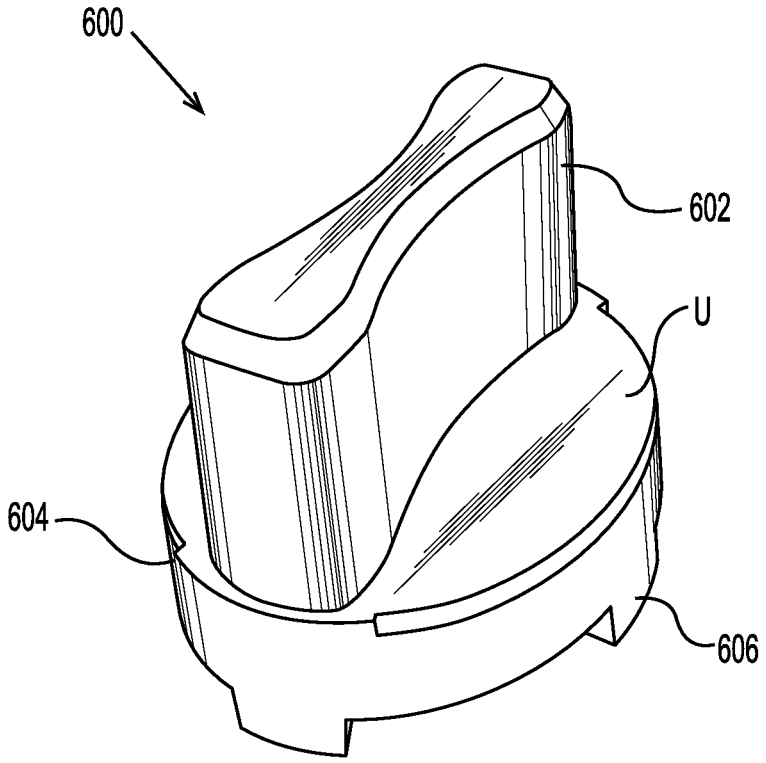
FIGS. 6A and 6B depict perspective views of a hand assembly tool, in accordance with an embodiment of the present invention.
Figure 6B:
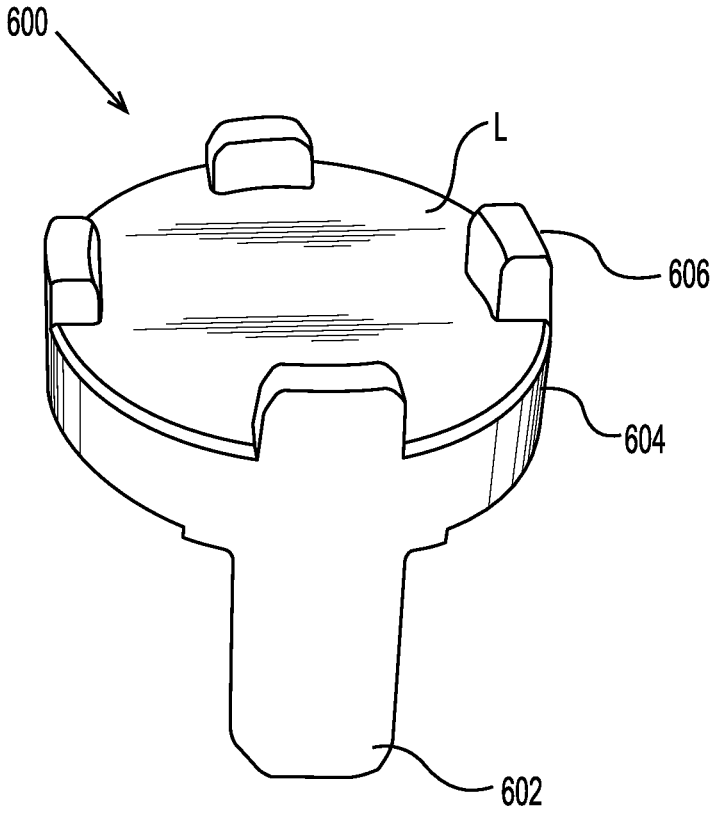

FIGS. 6A and 6B depict perspective views of a hand assembly tool 600, in accordance with an embodiment of the present invention. Specifically, FIG. 6A shows one position of the hand assembly tool 600 depicting handle 602 at upper side resting on a base 604. Alternatively, FIG. 6B illustrates a reverse side of the hand assembly tool 600. The hand assembly tool 600 may have similar functionality as the assembly tool 500 (described previously in conjunction with FIG. 5). Further, the hand assembly tool 600 may include the handle 602 that may be utilized to engage the hand assembly tool 600 with the retention ring 300.

The hand assembly tool 600 may provide more torque through the handle 602 to the rotation of the retention ring 300, such that the compressive fit between the winged protrusions 304 (of the retention ring 300) and the slots 106 (of the assembly component 104) will be maximized. Furthermore, the hand assembly tool 600 may ease the disassembly and reassembly of the lighting components during routine maintenance.

As shown, the hand assembly tool 600 may include the handle 602 that may be connected to one side 'U' (such as an upper side) of the base 604 of the hand assembly tool 600. The base 604 may generally be, but not restricted to, round. Further, it may be appreciated by a person skilled in the art that the base 604 (like the base 506 in FIG. 5A) may be of any geometrical shape to fit in the retention ring 300. Further, the hand assembly tool 600 may include protrusions 606 on lower side 'L' (as depicted clearly in FIG. 6B) of the hand assembly tool 600.

The protrusions 606 may be shaped and sized such that they may fit into notches in the retention ring 300 created by the bottom ledges 308 (as explained previously in conjunction with FIG. 3 and FIG. 5) for creating a required torque to the retention ring 300 for enhancing or reducing the compressive fitting between the winged protrusions 304 and the slots 106 of an assembly component, such as the assembly component 104. Further, based on the requirements, the handle 602 may be moved in clockwise or anti-clockwise direction to assemble or disassemble the lighting component or any other secured mechanism.

Figure 6C:
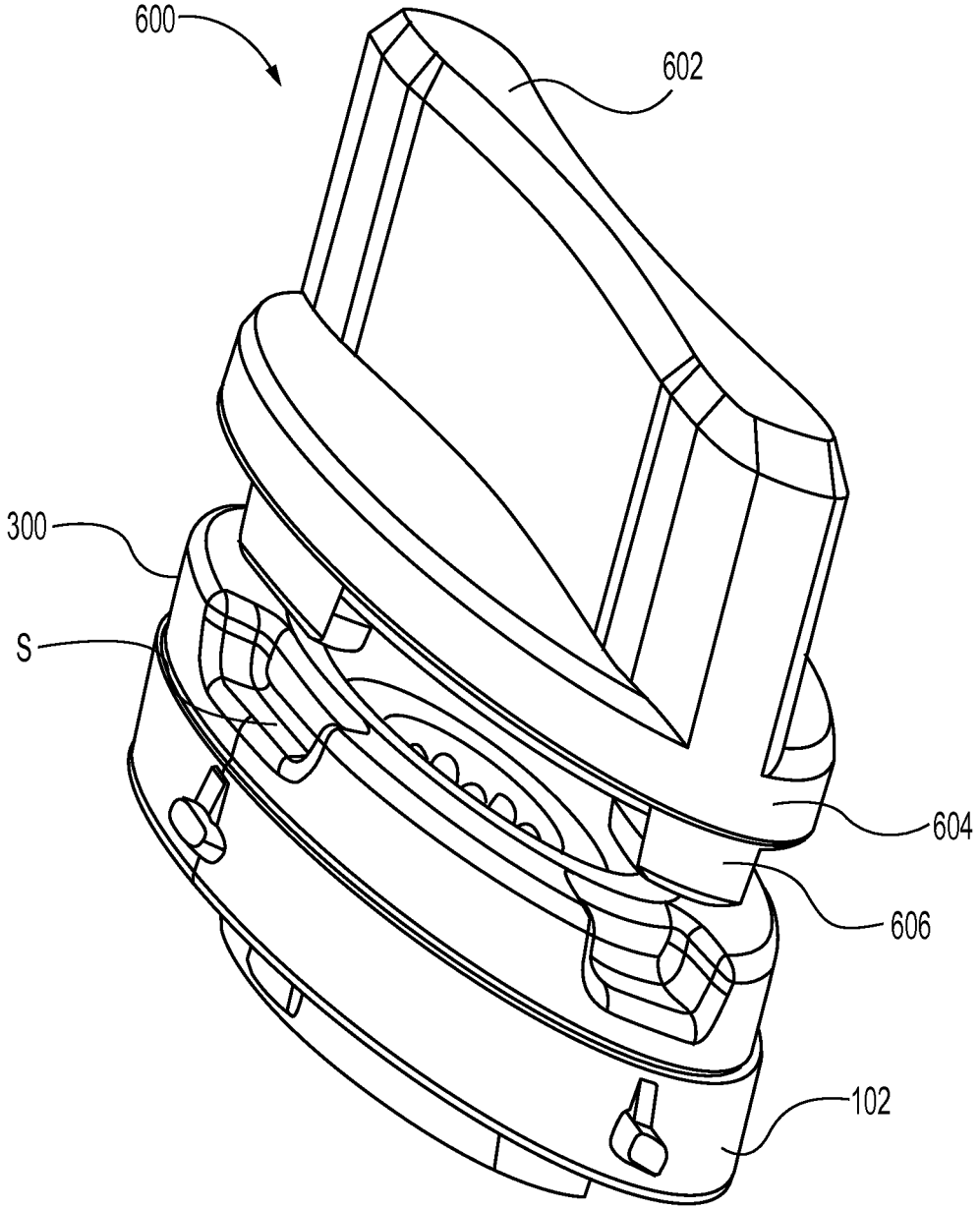
FIG. 6C illustrates a way to engage the hand assembly tool with a retention ring to tighten or disassemble an assembly comprising a base, a lighting module, and the retention ring, in accordance with an embodiment of the present invention.

FIG. 6C illustrates a way to engage the hand assembly tool 600 with a retention ring, such as the retention ring 300, to tighten or disassemble an assembly comprising a base, a lighting component, and the retention ring, in accordance with an embodiment of the present invention. As depicted the hand assembly tool 600 may be engaged with an assembly comprising a base 102 and a retention ring 300. Specifically, the hand assembly tool 600 may provide more torque (by rotating the handle 602) to the rotation of the retention ring 300, such that may be compressive fit between the winged protrusions 304 and the slots 106 will be maximized.

As shown, the protrusions 606 of the hand assembly tool 600 may be fit between slots, such as a slot 'S' of the retention ring. After fitting inside the slot, the handle may be rotated clockwise or anti-clockwise to assemble or disassemble the assembly. The protrusions 606 may be shaped and sized such that it may fit into the notches in the retention ring 300. Such fitting of the protrusions 606 within the retention ring 300 may be for creating a required torque to the retention ring 300 to enhance the compressive fitting between winged protrusions (such as the winged protrusions 304) of the retention ring 300 and the slots 106 of an assembly component, such as the assembly component 104.

Further, the hand assembly tool 600 will generally be made of a sturdy material, such as steel, aluminum, and plastic and/or composites and the like. The protrusions 606 may engage with at least one stopper of the retention ring 300. Due to this, the winged protrusions of the retention ring may engage with slots of the assembly component of the base (such as the base 102) and thereby securing the lighting component such that its surface is firmly in contact with the base. It may be appreciated by a person skilled in the art that the usage of the hand assembly tool 600 may create a tighter fit than if the retention ring were rotated manually.

In an embodiment, the handle is interchangeable depending on a type of housing that is required to be accessed for assembling or disassembling by using the hand assembly tool. It may be appreciated by a person skilled in the art that by using hand assembly tool, it may be easier to remove LED or any other light engine from its holder without straining fingers/hand.

Figure 7A:
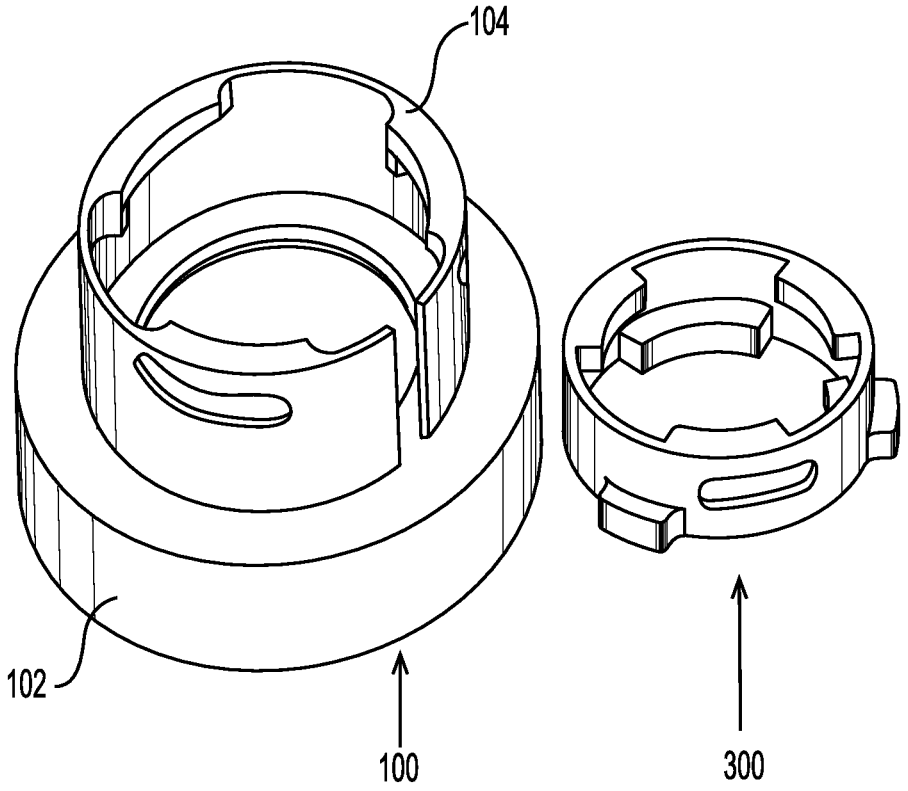
FIGS. 7A, 7B and 7C depict various perspective views of a base and a retention ring in accordance with an embodiment of the present invention.
Figure 7B:
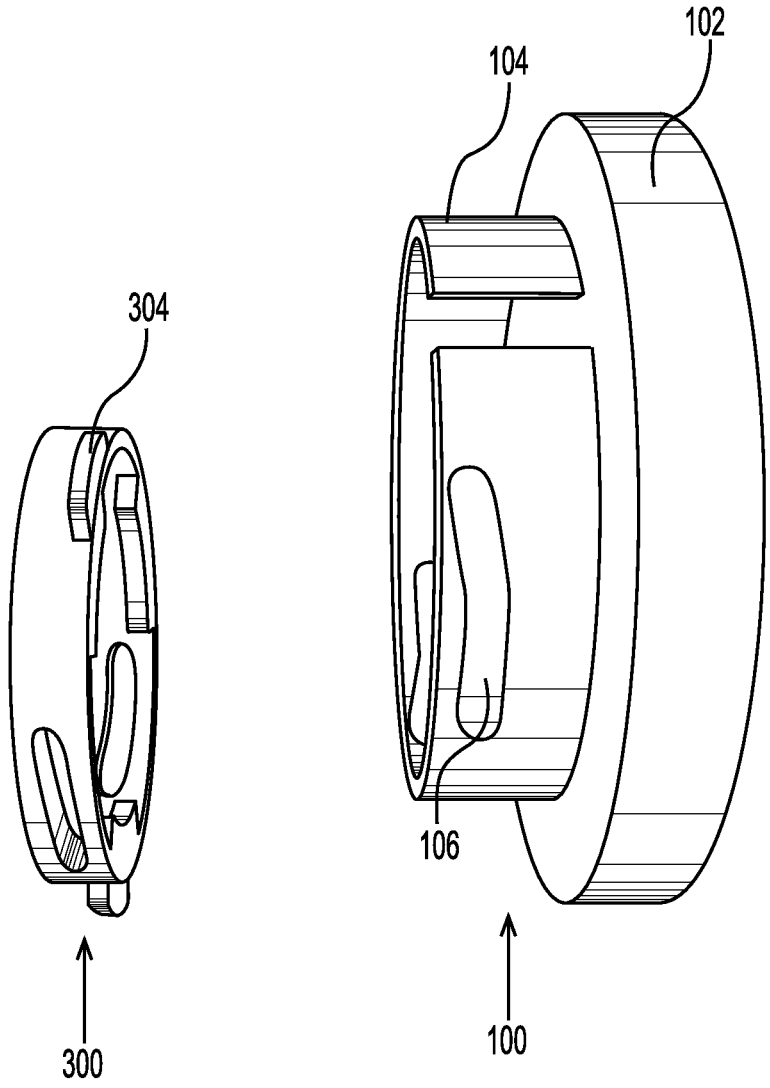
Figure 7C:
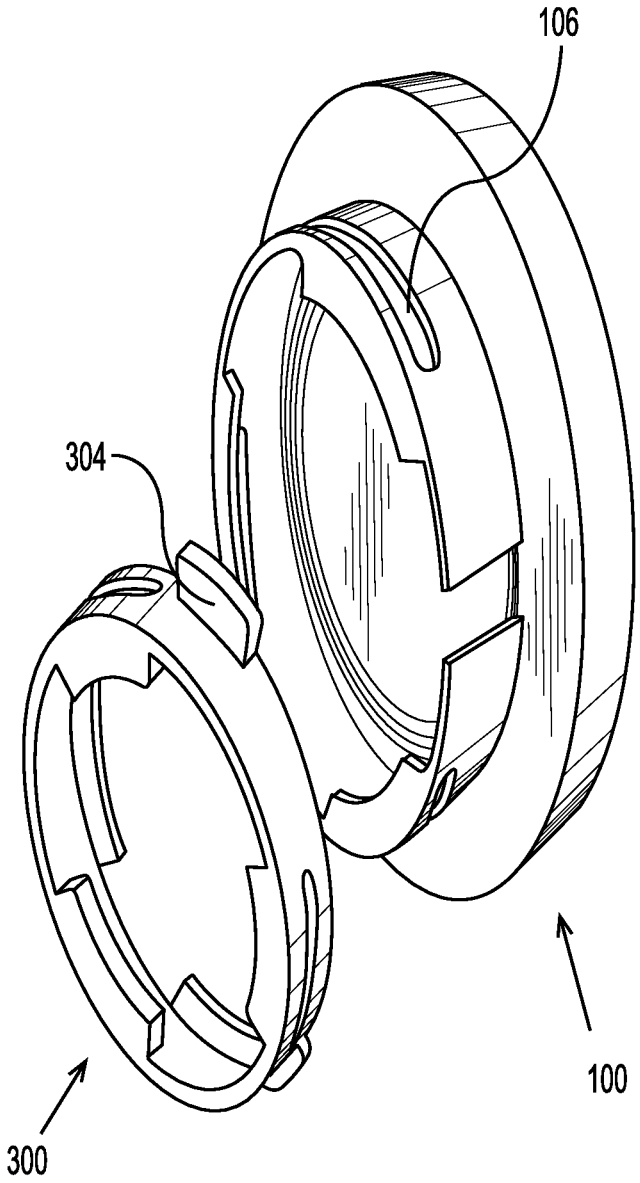

FIGS. 7A, 7B and 7C depict various perspective views of a base and a retention ring, in accordance with an embodiment of the present invention. The base may be such as the base 100 as described in conjunction with FIG. 1, and FIGS. 2A-2F. Similarly, the retention ring may be such as the retention ring 300, as described in conjunction with FIG. 3 and FIGS. 4A-4C. The base 100 and the retention ring 300 may be constructed of, but is not limited to, a sturdy material capable of acting as a conductor, such as steel, aluminum, nickel, and the like.

As described previously, the base 100 may include a mounting component, such as the mounting component 102, and an assembly component, such as the assembly component 104. In addition, the mounting component 102 may further have a channel that may extend radially from the lighting component compartment to the edge of the mounting component 102 (as described further in conjunction with FIGS. 9A and 9B). Wires from the lighting component may extend out of the base through this channel for connection thereof within a wall or ceiling. Further, it may be appreciated by a person skilled in the art that the wires (from the lighting component) may sit within the channel in a way such that the wires do not interfere with any of the edges of either the assembly component 104 or the retention ring 300. The depth of the channel for the wires of the lighting component may vary depending upon the lighting component to be secured.

Further, the retention ring 300 may comprise two or more winged protrusions such as 304 (as depicted) that may lock a lighting component inside the assembly component 104 by fixing with a bottom edge of a slot 106 (as depicted in FIGS. 7B and 7C). Specifically, the retention ring 300 may be adjusted by rotating so as to come into contact with the bottom edge of a slot 106, and thereby creating a compressive force between the winged protrusions 304 and the slots 106.

Figure 8:
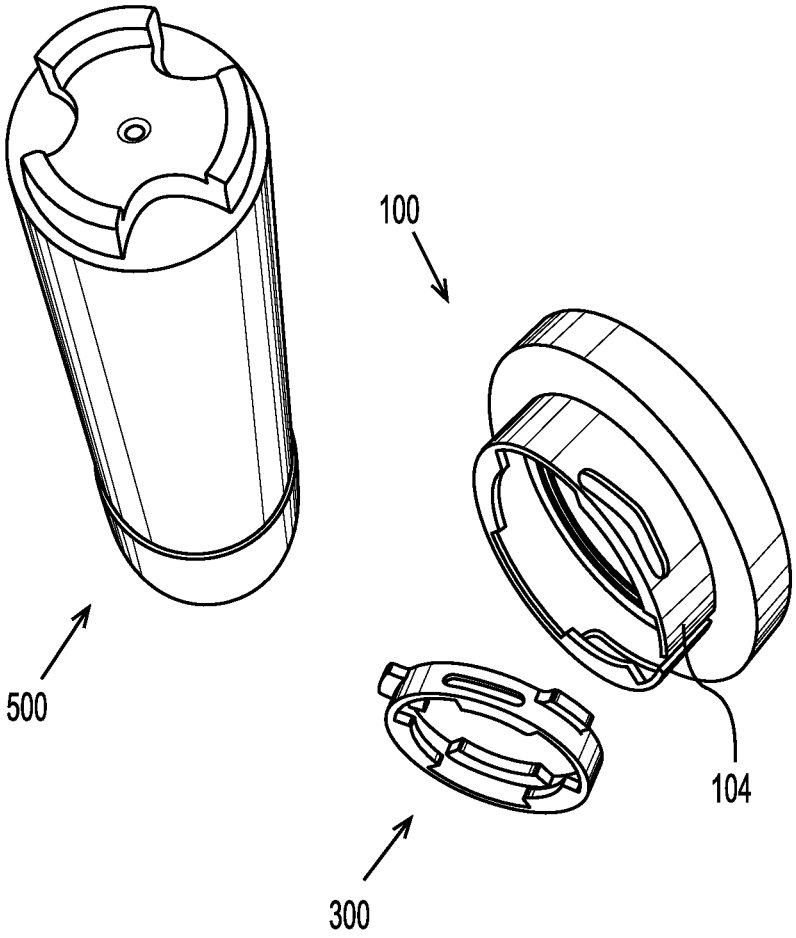
FIG. 8 depicts a perspective view of a base, a retention ring, and an assembly tool in accordance with an embodiment of the present invention.

Referring now to FIG. 8 that depicts a perspective view of a base (such as the base 100), a retention ring (such as the retention ring 300), and an assembly tool (such as the assembly tool 500) in accordance with one embodiment of the present invention. The assembly tool 500 may be utilized to tighten the retention ring 300 into the assembly component 104 of the base 100. Further, the assembly tool 500 may be utilized to disassemble the retention ring 300 from the assembly component 104 of the base 100. The assembly tool 500 is explained previously in conjunction with FIG. 5 and thus not described here in detail again for the sake of brevity.

Figure 9A:
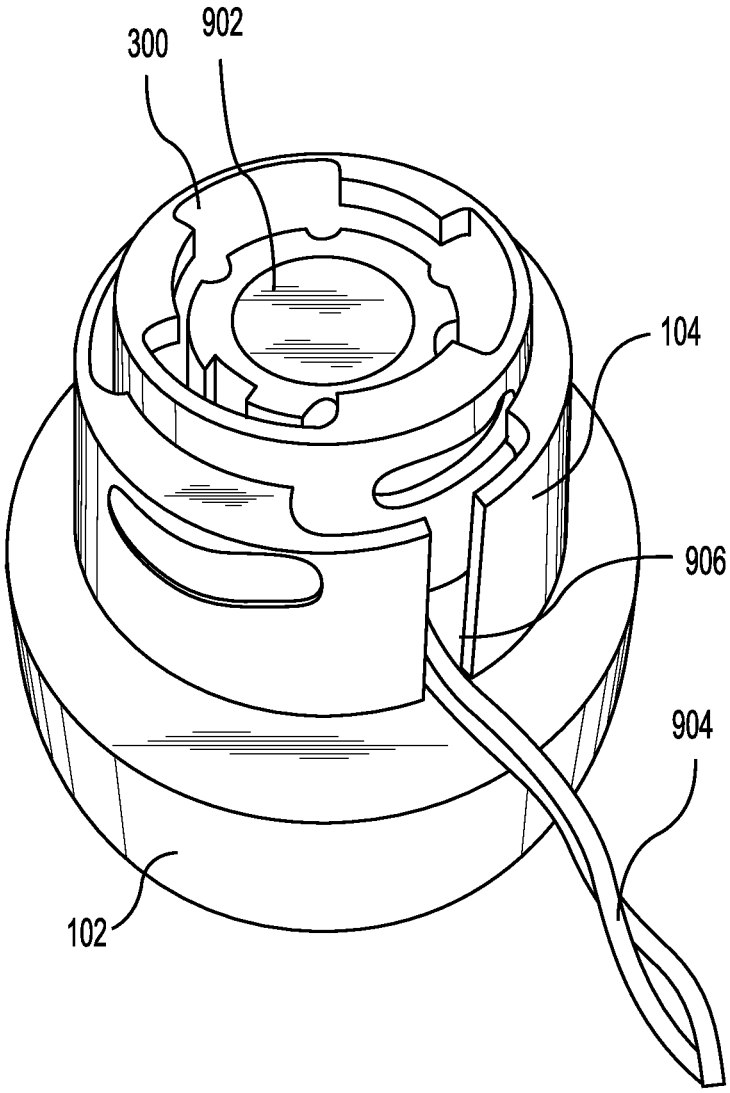
FIGS. 9A and 9B depict perspective views of an assembly comprising a base, a lighting module, and a retention ring in accordance with an embodiment of the present invention.
Figure 9B:
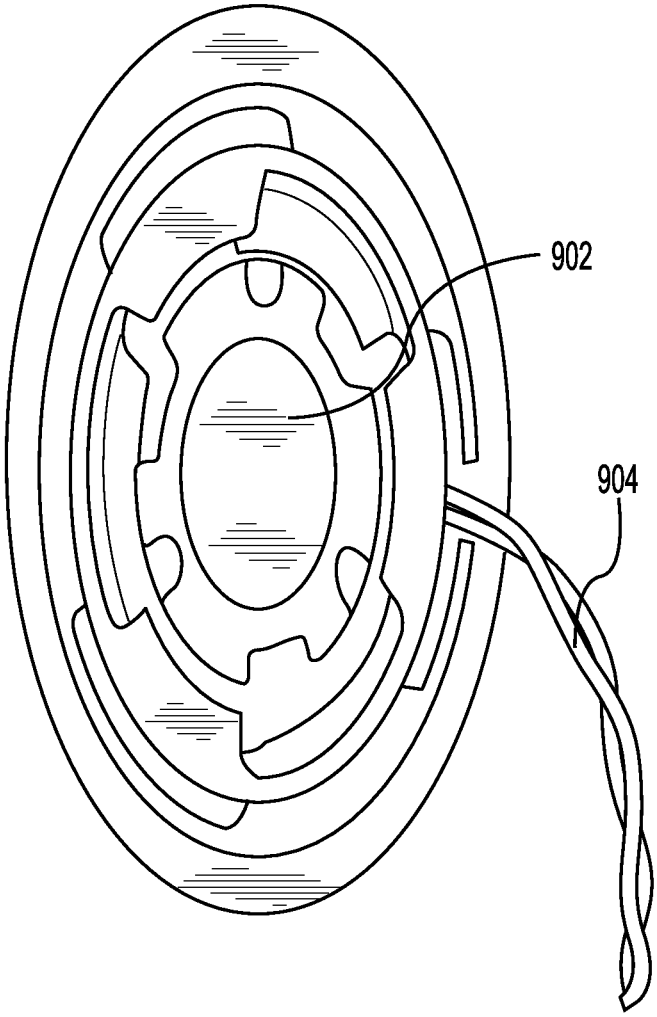

FIGS. 9A and 9B depict perspective views of an assembly comprising a base, a lighting module, and a retention ring in accordance with one embodiment of the present invention. Specifically, FIG. 9B depicts a top view of a lighting component 902 securely locked by the locking mechanism comprising a base 100 and a retention ring 300. The assembly is shown upside down for ease of assembly. The lighting component 902 may sit in the lighting component compartment of the mounting component, such as the mounting component 102, of the base 100. The lighting component 902 may be positioned such that wires 904 of the lighting component 902 may pass through an opening 906 in the wall of the assembly component 104 of the base 100. The wires 904 furthermore may sit in a channel (depicting through the opening 906) that extends outwardly from the lighting component compartment to the edge of the mounting component 102.

The retention ring 300 may slide into the assembly component 104, with the winged protrusions fitting through the notches created by the bottom edges of the assembly component 104. The top surface of the top ledges of the retention ring 300 may come into contact with the bottom surface of the lighting component 902, holding the lighting component 902 in the lighting component compartment of the mounting component 102. When the retention ring 300 is rotated, the winged protrusions of the retention ring 300 may engage with the slots of the assembly component 104 of the base 100, thereby creating a compression that may forcibly lock the lighting component 902 in place.

Figure 9C:
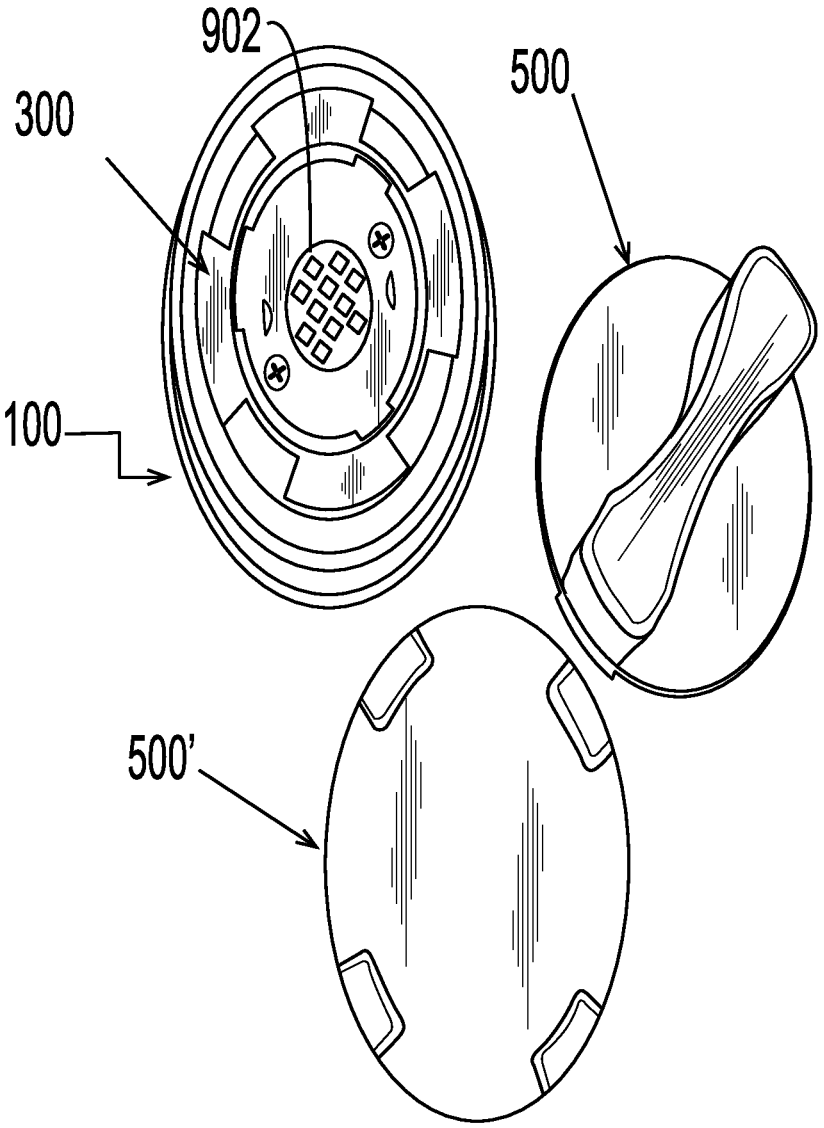
FIG. 9C depicts a perspective view of an assembly comprising a base, a lighting module and retention ring, as well as a top and bottom view of an assembly tool for tightening and disassembling the assembly; in accordance with an embodiment of the present invention.

FIG. 9C depicts an embodiment FIG. 9C depicts a perspective view of an assembly comprising a base 100, a lighting module 902 and retention ring 300, as well as a top view 500 and bottom view 500' of an assembly tool for tightening and disassembling the assembly.

Figure 10A:
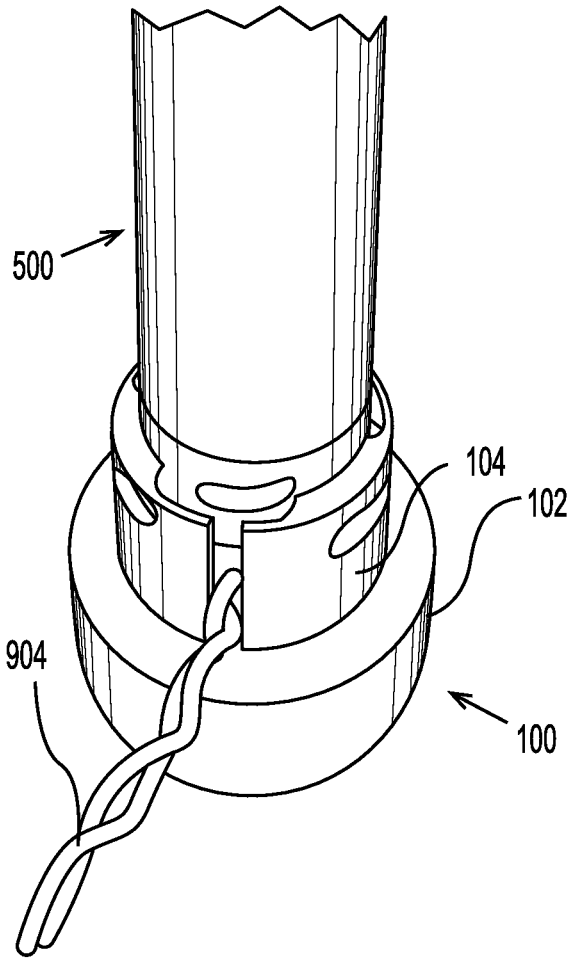
FIGS. 10A and 10B depict perspective views, illustrating a way of using an assembly tool to tighten and disassemble, respectively, an assembly comprising a base, a lighting module, and a retention ring, in accordance with an embodiment of the present invention.
Figure 10B:
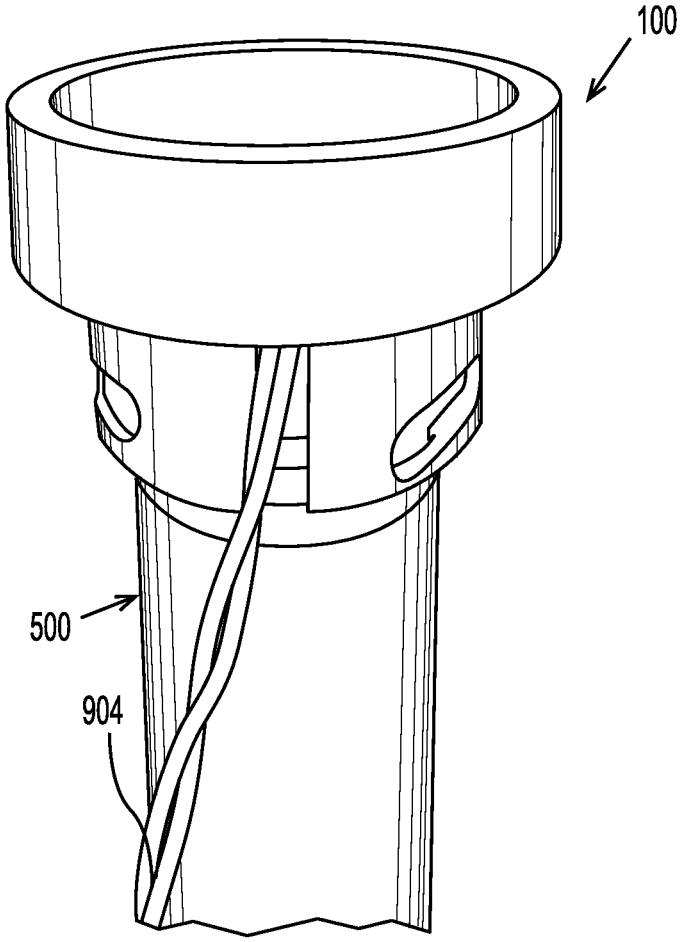

FIGS. 10A and 10B depict a perspective views, illustrating a way of using an assembly tool, such as the assembly tool 500, to tighten and disassemble respectively an assembly comprising a base (such as the base 100), a lighting module (such as an LED or light engine), and a retention ring (such as the retention ring 300), in accordance with one embodiment of the present invention. As shown in FIG. 10A, the retention ring 300 may fixed to the base 100 and the assembly tool 500 may be fixed inside the retention ring 300 to compressively fit the retention ring 300 with the assembly component 104 of the base and thereby to securely lock a lighting component in the base 100. Alternatively, FIG. 10B depict a way for using the assembly tool 500 that may be used to disassemble the retention ring 300 and the base 100.

Figure 11A:
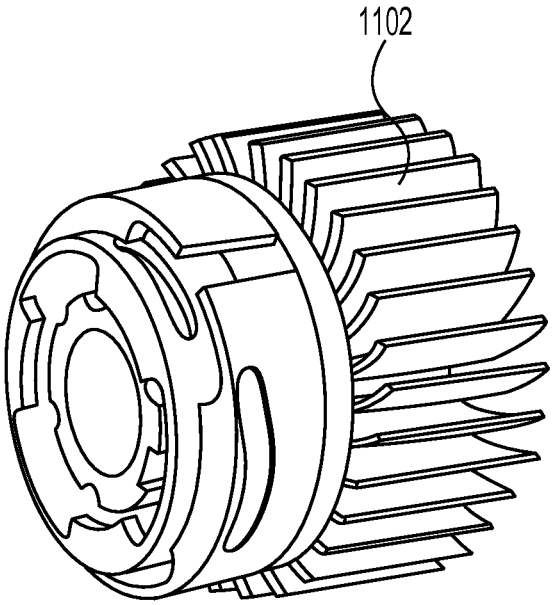
FIGS. 11A and 11B depict compressed and exploded views of an apparatus with a locking mechanism in accordance with an embodiment of the present invention.
Figure 11B:
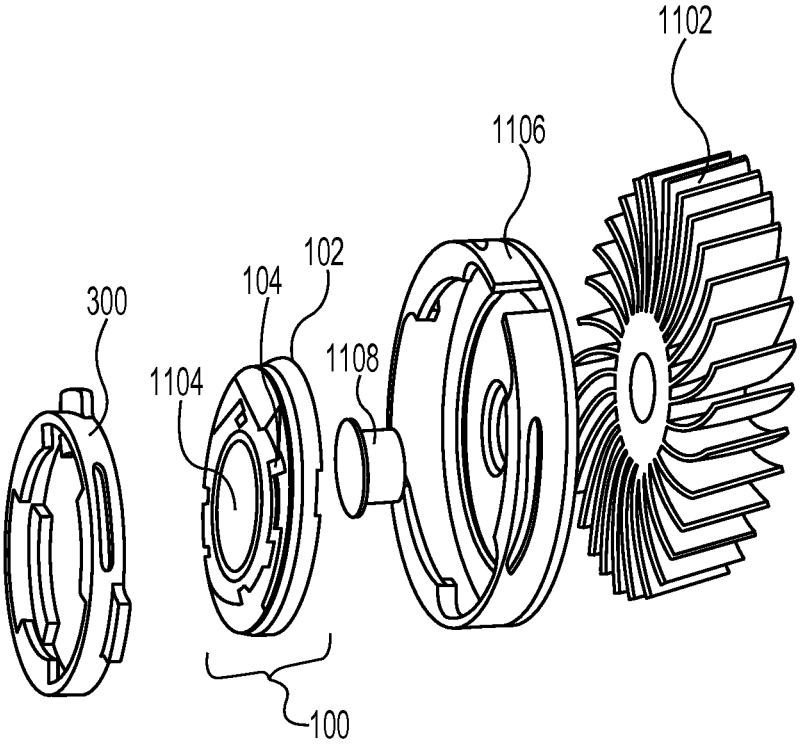

FIGS. 11A and 11B depict compressed and exploded views of an apparatus with a locking mechanism without using screws or other external fasteners, in accordance with one embodiment of the present invention. Specifically, FIG. 11A depicts a perspective view of the an apparatus with the locking mechanism including a base, such as the base 100 and a retention ring, such as the retention ring 300. Further, as shown, the locking mechanism secures lighting components such as an LED component and a heat sink 1102 with each other. Further FIGS. 11A and 11B depict large heat sink configuration having large fins for dissipating heat that may be produced by a lighting component secured in the base. Further, FIG. 11B depicts an exploded view with large heat sink configuration.

As depicted in FIG. 11B, a base 100 may include a mounting component (such as the mounting component 102) and an assembly component (such as the assembly component 104). As shown, the retention ring 300 may be engaged with the assembly component after placing a lighting component 1104 in a lighting component chamber of the mounting component. The retention ring may be engaged with the assembly component to secure the lighting component housed in the mounting component of the base. The engaging mechanism of the retention ring with the assembly component is explained previously in detail in conjunction with FIG. 3 and thus not described herein again for the sake of brevity. Further, FIG. 11B depicts a compartment 1106 that may be attached to another side (other than the side where retention ring is engaged) of the mounting component of the base. Further, the compartment 1106 may be utilized to connect the heat sink 1102 with the mounting component by utilizing a component 1108. The heat sink 1102 may have large or small fins to dissipate heat produced by the lighting component that may be transferred to the heat sink 1102. Further, connection of various components of the locking mechanism is described previously in conjunction with FIGS. 1 and 3 and thus not described again for the sake of brevity. Further, in an embodiment, the present invention may utilize a small heat sink configuration as depicting in FIGS. 12A and 12B.

Figure 12A:
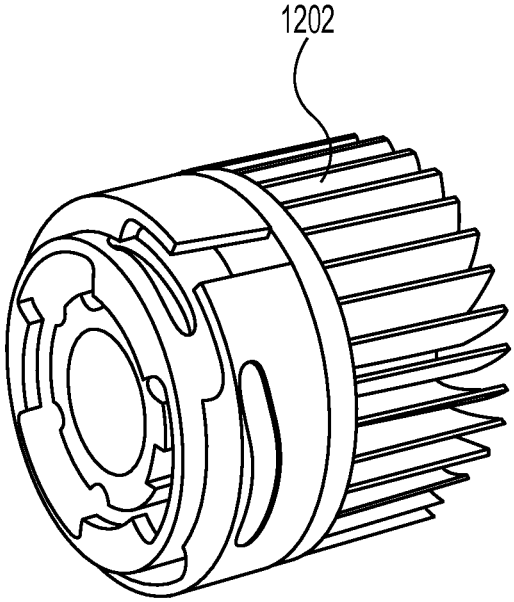
FIGS. 12A and 12B depict compressed and exploded views of an apparatus with a locking mechanism for lighting components in accordance with another embodiment of the present invention.
Figure 12B:
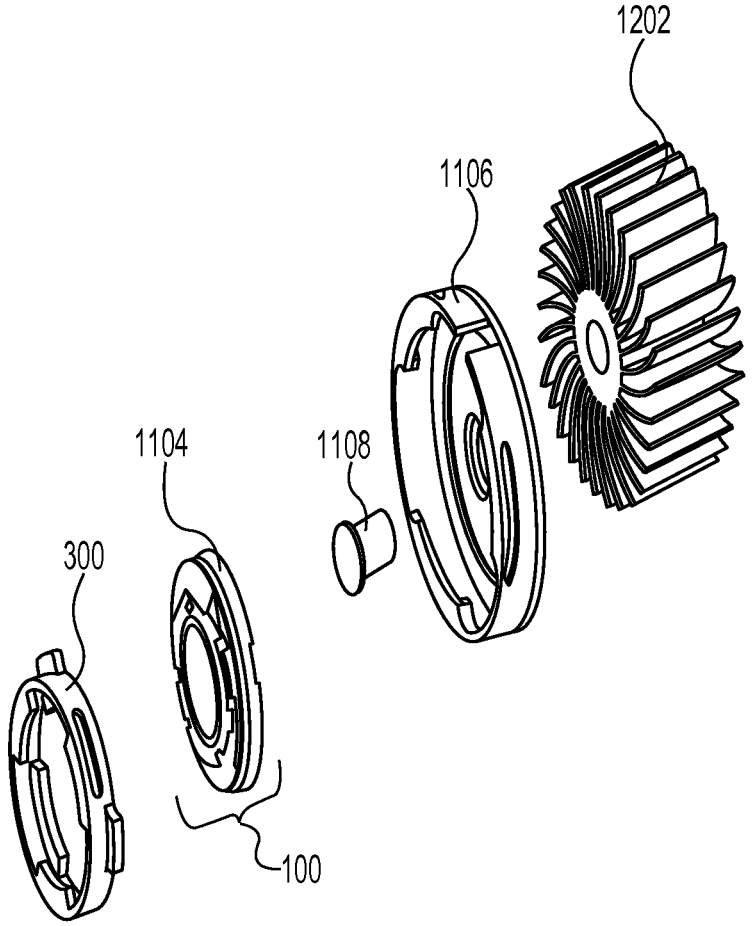

FIGS. 12A and 12B depict compressed and exploded views respectively of an apparatus with a locking mechanism for lighting components, without using screws or other external fasteners, in accordance with another embodiment of the present invention. Specifically, FIGS. 12A and 12B depict a small heat sink configuration using a small heat sink 1202 that may be utilized for dissipating heat that may be produced by the lighting component. Further, the components illustrated in FIGS. 12A and 12B are described previously in conjunction with FIGS. 11A and 11B and thus not described again for the sake of brevity.

Figure 13A:
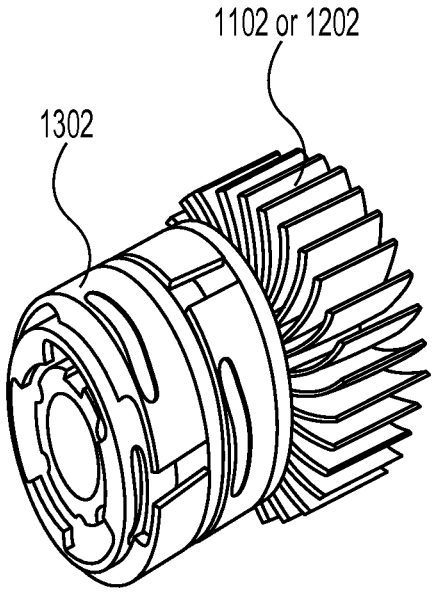
FIGS. 13A and 13B depict compressed and exploded views of an apparatus using an extension for locking a lighting component in accordance with an embodiment of the present invention.
Figure 13B:
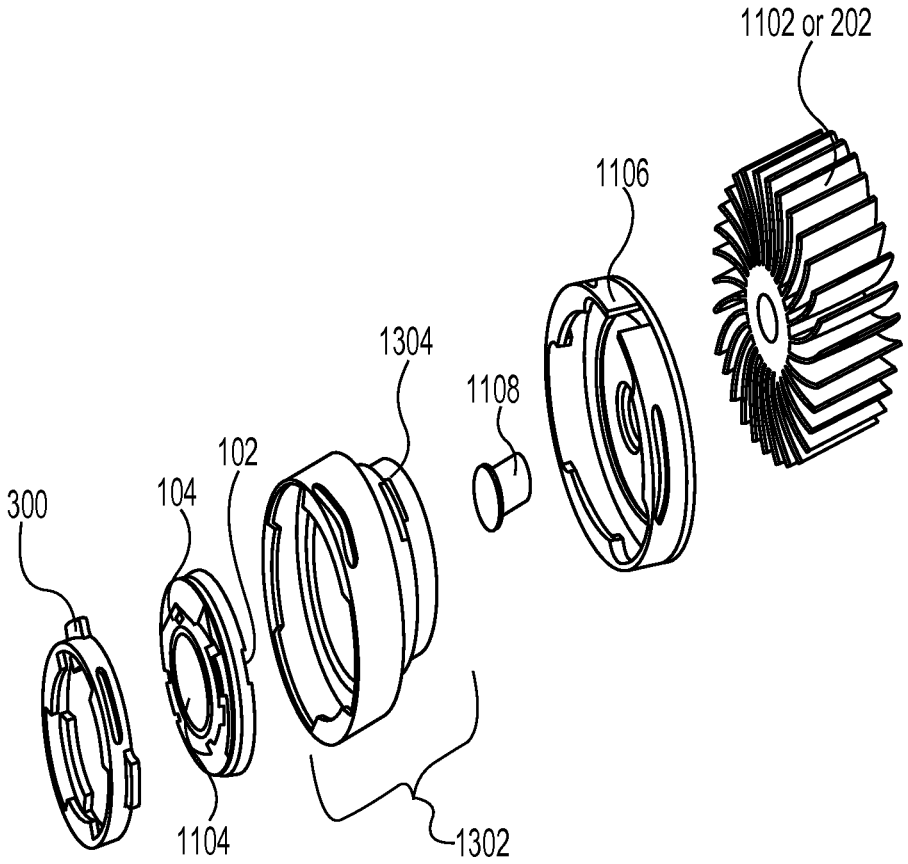

FIGS. 13A and 13B depict compressed and exploded views of an apparatus using an extension for locking a lighting component, in accordance with an embodiment of the present invention. Specifically, FIGS. 13A and 13B depict usage of an extension 1302 that may be engaged to the mounting component 102 on opposite side of the retention ring 300. Further, the compartment 1106 may be connected to the extension 1302 from a portion 1304 thereof. Accordingly, the length of the apparatus for locking various lighting components may be increased by using an extension, such as the extension 1302. Further, the heat that may be produced by the lighting component may be transferred from a passage (heat pipe, 1302 behaves like a heat pipe) inside the extension 1302 to the heat sink, such as heat sink 1102 (in case of large heat sink configuration) or heat sink 1202 (in case of small heat sink configuration). Further, it may be appreciated by a person skilled in the art that the extension may have one or more slots and ledges to fix (along circumferential portions thereof) with the mounting component and the compartment 1106 without using screw or any other external fastener. Further, it may be appreciated by a person skilled in the art that more than one extension, such as the extension 1302, may be utilized by the present invention.

Figure 14A:
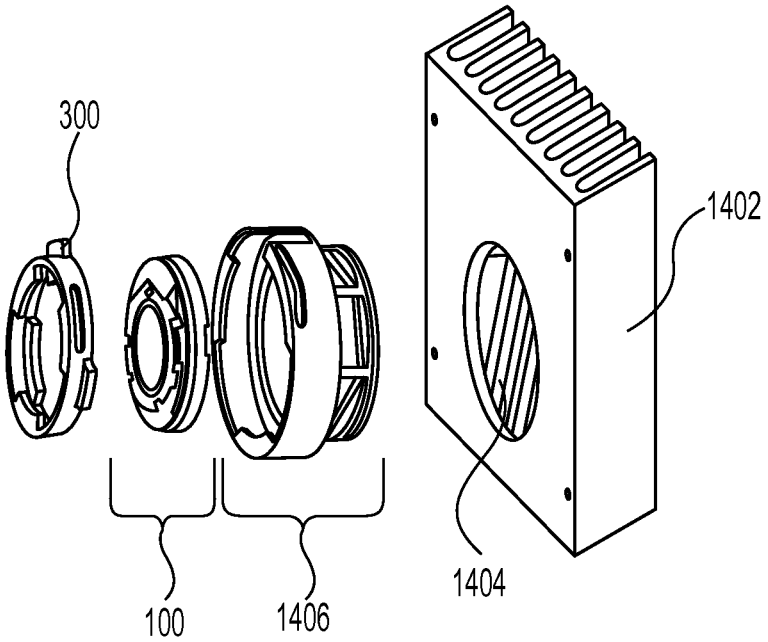
FIGS. 14A and 14B depict a compressed view and an exploded view of an apparatus for locking a lighting component using square configuration of a heat sink, in accordance with an embodiment of the present invention.
Figure 14B:
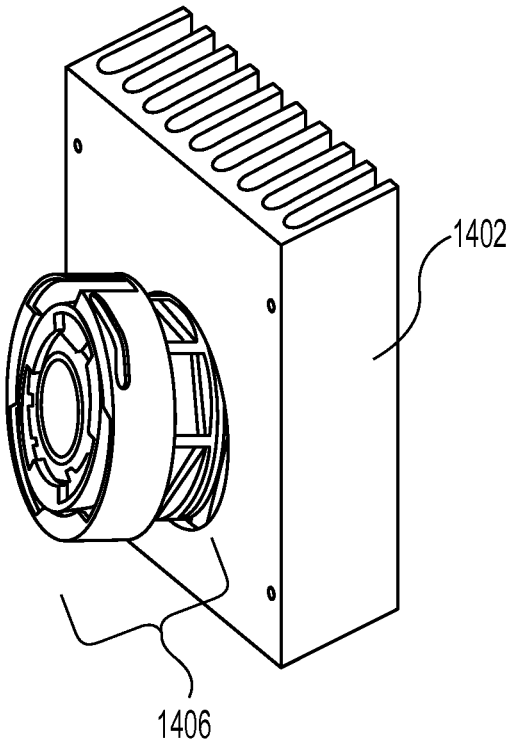

FIGS. 14A and 14B depict a compressed view and an exploded view of an apparatus for locking a lighting component using square configuration of a heat sink, in accordance with an embodiment of the present invention. As depicted, a square configuration heat sink 1402 is utilized for dissipating heat produced by a lighting component. Further, as shown, the heat sink 1402 may include an orifice 1404 for allowing an extension 1406 (such as 1302) to engage within the orifice 1404. Based on shape and size of the orifice 1404, shape and size of the extension 1406 may be adapted for engaging the apparatus with the heat sink 1402 using the extension 1406. Further, it may be appreciated by a person skilled in the art that the heat sink utilized by the present invention may not be limited to the shape and design as described above in this disclosure. Further, various shapes and design may be utilized for the heat sink and accordingly, any component (such as the extension 1406) that may be connected to the heat sink may be designed accordingly so as to engage with the heat sink.

Figure 15:
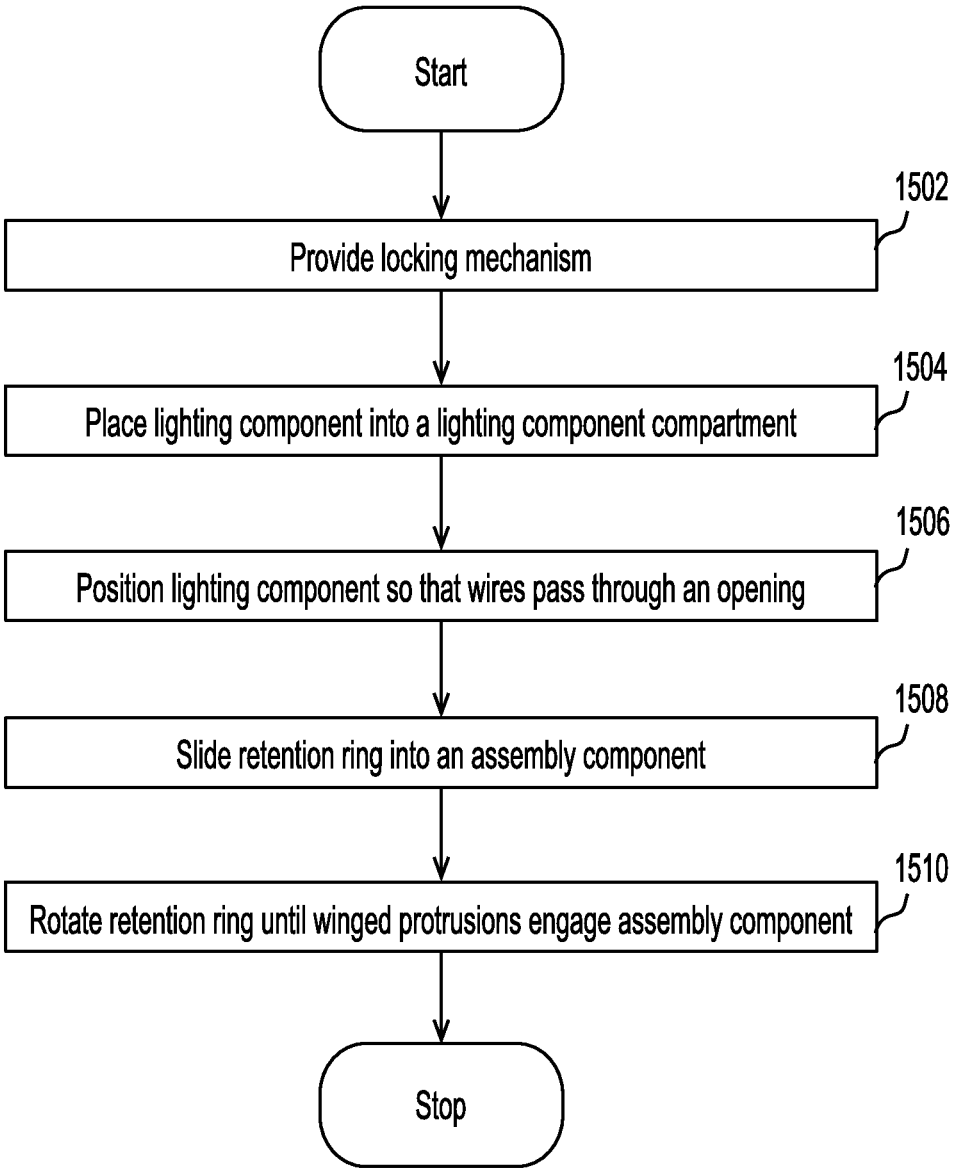
FIG. 15 illustrates an exemplary flowchart depicting a method for securely locking lighting components to each other, in accordance with an embodiment of the present invention.

FIG. 15 illustrates an exemplary flowchart depicting a method for securely locking one or more lighting components to each other, in accordance with an embodiment of the present invention. In an embodiment, a locking component, such as an LED or light engine, may be securely locked to a base, such as the base 100. The order in which the method is performed is not intended to be construed as limitation, and further any number of the method steps may be combined in order to implement the method or an alternative method without departing from the scope of the present invention.

At step 1502, the base and retention ring of a locking mechanism is provided. The base may be as depicted in FIG. 1 or FIG. 7A and the retention ring may be as depicted in FIG. 3 or FIG. 7A. Herein, the base may include a mounting component and an assembly component. At step 1504, a lighting component intended to be secured may be placed into a lighting component compartment of the mounting component of the base. Further, at step 1506, the lighting component compartment may be positioned in a manner such that wires of the lighting component may pass through an opening in a wall of the assembly component of the base. After placing the lighting component in the lighting component compartment, at step 1508, the retention ring may be slid into the assembly component of the base until a top surface of at least one top ledge of the retention ring comes into contact with a bottom surface of the lighting component. Further, at step 1510, the retention ring may be rotated until winged protrusions of the retention ring comes into contact with edges of the assembly component slots, creating a compression force between the winged protrusions and the slots such that the lighting component is securely locked. In addition to the above described method steps, an assembly tool, such as the assembly tool 500 as depicted in FIGS. 5A-5D, may be inserted through the bottom of the retention ring, and rotated to apply greater torque to the retention ring such that a more secure lock is generated.

Further, in an additional embodiment of the present invention, heat sink may be connected to the mounting component by utilizing similar locking mechanism as utilized for fitting the retention ring with the assembly component. For this, shape and design of the mounting component may flexibly be changed from the top portion thereof to fit with the heat sink. The heat sink is described previously in conjunction with FIGS. 11A, 11B, 12A, 12B, 13A, 13B, 14A and 14B and thus not described herein again for the sake of brevity. In an embodiment, the method (as described above) may be implemented automatically through an apparatus designed to perform the functionalities for securely interlocking lighting components to each other.

It may be appreciated by a person skilled in the art that the present invention is not limited to the description provided above with the help of drawings. Further, positions, designs and sizes of various components, as shown in drawings, may not be considered as limiting. Various other embodiments in light of the scope of the present invention may be implemented. Further, the terms like first, second, up, down and the like should not be considered as limiting for the present invention. Additionally, it may be appreciated by a person skilled in the art that the various embodiments of the present invention are not limited to securing lighting component, such as LEDs or other light engines. Further, the embodiments of the present invention may be utilized for securing, assembling or disassembling any secured fixture having suitable shape and size without departing from the scope of the present invention.

Advantageously, the present invention may provide a locking mechanism, an apparatus, and a method thereof for securely interlocking lighting components, such as an LED/light engine and a heat sink. The locking mechanism of the present invention (as described above) eliminates the need for extraneous fasteners, such as screws, thereby minimizing the cost and time for both assembly and maintenance. Further, the present invention may utilize an extension that may be engaged with a heat sink. The heat sink utilized by the present invention may be of various shapes and sizes.

While the foregoing is directed to embodiments of the present invention, other and further embodiments of the present invention may be devised without departing from the basic scope thereof. In particular, it should be appreciated that any element of any embodiments disclosed herein may be combined with any other elements from any other embodiments disclosed herein, in accordance with yet further embodiments of the present invention.

The present invention, in various embodiments, configurations, and aspects, includes components, methods, processes, systems, kits and apparatus substantially as depicted and described herein, including various embodiments, subcombinations, and subsets thereof. Those of skill in the art will understand how to make and use the present invention after understanding the present disclosure. The present invention, in various embodiments, configurations, and aspects, includes providing apparatus and processes in the absence of items not depicted and/or described herein or in various embodiments, configurations, or aspects hereof, including in the absence of such items as may have been used in previous devices or processes, e.g., for improving performance, achieving ease and reducing cost of implementation.

The foregoing discussion of the present invention has been presented for purposes of illustration and description. The foregoing is not intended to limit the present invention to the form or forms disclosed herein. In the foregoing Detailed Description for example, various features of the present invention are grouped together in one or more embodiments, configurations, or aspects for the purpose of streamlining the disclosure. The features of the embodiments, configurations, or aspects of the present invention may be combined in alternate embodiments, configurations, or aspects other than those discussed above. This method of disclosure is not to be interpreted as reflecting an intention that the claimed invention requires more features than are expressly recited in each claim. Rather, as the following claims reflect, inventive aspects lie in less than all features of a single foregoing disclosed embodiment, configuration, or aspect. Thus, the following claims are hereby incorporated into this detailed description, with each claim standing on its own as a separate preferred embodiment of the present invention.

Moreover, though the description of the present invention has included description of one or more embodiments, configurations, or aspects and certain variations and modifications, other variations, combinations, and modifications are within the scope of the present invention, e.g., as may be within the skill and knowledge of those in the art, after understanding the present disclosure. It is intended to obtain rights which include alternative embodiments, configurations, or aspects to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method for securely interlocking lighting components comprising:

providing a locking mechanism, the locking mechanism comprising:

a base comprising:

a mounting component comprising a bottom portion and a top portion, the bottom portion including a lighting component compartment for housing a lighting component therein, the top portion including a heat sink compartment that engages a heat sink, said heat sink for dissipating heat generated from the operation of the lighting component; and an assembly component comprises at least two sloped slots in at least one wall thereof; and a retention ring comprising:

at least one top ledge to engage with surface of the lighting component; and at least two winged protrusions;

placing the lighting component into the lighting component compartment;

sliding the retention ring into the assembly component for enabling contact between a top surface of the at least one top ledge and a bottom surface of the lighting component; and rotating the retention ring for engaging each of the at least two winged protrusions with one of the at least two sloped slots of the assembly component such that a compressive force is created between the winged protrusions and the sloped slots, and thereby securing the lighting component in contact with the base and the base in contact to the heat sink such that the heat sink dissipates heat generated by the light component during its operation.

2. The method of claim 1 further comprising positioning the lighting component compartment for enabling wires pass through the opening in the wall of the assembly component of the base.

3. The method of claim 1 further comprising providing means for engaging each of the at least two winged protrusions of the retention ring with one of the at least two sloped slots of the assembly component.

4. The method of claim 1 further comprising providing a tool for disassembling and reassembling of the lighting component for maintenance, the disassembling and reassembling performed by rotating the retention ring by utilizing the tool, said tool including a plurality of protrusions sized and shaped such that the plurality of protrusions fit into a plurality of notches formed in the retention ring and when said tool is turned a required torque is applied to the retention ring for enhancing or reducing compressive fitting between the winged protrusions and the sloped slots such that a desired compressive force is achieved between the lighting element, the base, and the heat sink.

* * * * *